US011566402B2

(12) United States Patent
Dueñas Ladrón De Guevara

(10) Patent No.: US 11,566,402 B2
(45) Date of Patent: Jan. 31, 2023

(54) SYSTEM FOR DOMOTIC CONTROL OF A PLUMBING INSTALLATION AND METHOD OF OPERATION TO INCREASE THE WATER EFFICIENCY OF THE SAME

(71) Applicant: MÉTRICA6 INGENIERÍA Y DESARROLLOS, S.L., Málaga (ES)

(72) Inventor: Eduardo Dueñas Ladrón De Guevara, Málaga (ES)

(73) Assignee: MÉTRICA6 INGENIERÍA Y DESARROLLOS, S.L., Málaga (ES)

( * ) Notice: Subject to any disclaimer, the term of this patent is extended or adjusted under 35 U.S.C. 154(b) by 491 days.

(21) Appl. No.: 16/499,088

(22) PCT Filed: Mar. 28, 2018

(86) PCT No.: PCT/ES2018/070272
§ 371 (c)(1),
(2) Date: Sep. 27, 2019

(87) PCT Pub. No.: WO2018/178483
PCT Pub. Date: Oct. 4, 2010

(65) Prior Publication Data

US 2020/0040556 A1 Feb. 6, 2020

(30) Foreign Application Priority Data

Mar. 31, 2017 (ES) ..... ES201700406

(51) Int. Cl.
*F16L 5/00* (2006.01)
*E03B 7/07* (2006.01)
(Continued)

(52) U.S. Cl.
CPC ..... *E03B 7/07* (2013.01); *E03B 1/04* (2013.01); *E03B 1/041* (2013.01); *E03B 7/04* (2013.01); *E03C 1/02* (2013.01); *E03C 1/12* (2013.01)

(58) Field of Classification Search
CPC ..... E03B 7/07; E03B 1/041; E03B 1/042
See application file for complete search history.

(56) References Cited

U.S. PATENT DOCUMENTS

2004/0182439 A1 9/2004 Popper et al.
2005/0235306 A1 10/2005 Fima
(Continued)

FOREIGN PATENT DOCUMENTS

EP 2 942 571 A1 11/2015
WO WO 2015/181411 A1 12/2015
(Continued)

OTHER PUBLICATIONS

International Search Report received in International Patent Application No. PCT/ES2018/070272 dated Mar. 28, 2018, in 6 pages.

*Primary Examiner* — Reinaldo Sanchez-Medina
(74) *Attorney, Agent, or Firm* — Knobbe, Martens, Olson & Bear, LLP

(57) ABSTRACT

The present invention relates to a water control system for the cold and hot water plumbing installations, for consumption or heating and gray water in a home, premises or building which increases water and/or energy efficiency of the installation by means of a method of operation which reduces the water consumption or energy used in its consumption and treatment: detecting and controlling water leaks, avoiding consumption of cold water which is produced while waiting for hot water to come out, reducing the energy required for consuming hot water, reducing consumption of water when it is used for the toilet together with a soap, foam or similar, measuring and controlling the
(Continued)

proliferation of *Legionella* bacteria and other microorganisms, cleaning pipes and in general monitoring the control variables of a plumbing installation and its visualization and interaction by a user or a smart and autonomous IT system.

13 Claims, 15 Drawing Sheets

(51) Int. Cl.

| | |
|---|---|
| ***E03B 1/04*** | (2006.01) |
| ***E03B 7/04*** | (2006.01) |
| ***E03C 1/02*** | (2006.01) |
| ***E03C 1/12*** | (2006.01) |

(56) References Cited

U.S. PATENT DOCUMENTS

| | | | |
|---|---|---|---|
| 2010/0096018 | A1 | 4/2010 | Wylie et al. |
| 2010/0126604 | A1 | 5/2010 | Lund et al. |
| 2016/0077530 | A1 | 3/2016 | Moran et al. |

FOREIGN PATENT DOCUMENTS

| | | | |
|---|---|---|---|
| WO | WO 2015/183258 | A1 | 12/2015 |
| WO | WO 2016/077509 | A1 | 5/2016 |

SYSTEM FOR DOMOTIC CONTROL OF A PLUMBING INSTALLATION AND METHOD OF OPERATION TO INCREASE THE WATER EFFICIENCY OF THE SAME

CROSS-REFERENCE TO RELATED APPLICATIONS

This application is the U.S. National Phase under 35. U.S.C. § 371 of International Application PCT/ES2018/070272, filed Mar. 28, 2018, which claims priority to Spanish Patent Application No. P201700406, filed Mar. 31, 2017. The disclosures of the above-described applications are hereby incorporated by reference in their entirety.

OBJECT OF THE INVENTION

The present invention relates to a water control system for cold and hot water plumbing installations, for consumption or heating and gray water in a home, premises or building which increases water and/or energy efficiency of the installation by means of a method of operation which reduces the consumption of water or energy used in its consumption and treatment: detecting and controlling water leaks, avoiding consumption of cold water which is produced while waiting for hot water to come out, reducing the energy required for consuming hot water, reducing consumption of water when it is used for the toilet together with a soap, foam or similar, measuring and controlling the proliferation of *Legionella* bacteria and other microorganisms, cleaning pipes and in general monitoring the control variables of a plumbing installation and its visualization and interaction by a user or a smart and autonomous IT system.

BACKGROUND OF THE INVENTION

At present, there are technologies for solving some of the existing problems in water supply installations, including the part of said installations corresponding to gray water and waste water from consumption points, relating to problems affecting the water efficiency of said installation, that is to say, the relation between the water entering said installation and that which is ultimately used, as well as problems stemming from its salubrity. The water efficiency of an installation provides for intended or unintended losses of flow resulting in the need for a greater volume of water to carry out determined applications, while salubrity is essential to guarantee the maintenance and usability of an installation for consumption. Of the potential problems in an installation stemming from water efficiency, the proposed invention aims to resolve specifically the following: the loss of cold water required to use hot water in a consumption point and detecting leaks of water in elements which are dripping or due to breakages in the installation. With respect to salubrity, the invention proposes a method of testing said salubrity with respect to a specific bacterium, *Legionella*, in addition to a method applicable for reducing the quantity of any type of microorganism and/or preventing its appearance.

The invention, in turn, involves a significant improvement in the energy efficiency of the installation with respect to other current alternatives by means of compartmentalization and automatization of closed double branch recirculation circuits and compartmentalization and automatization of closed recirculation circuits for heating or heat exchange. Similarly, the system object of the invention provides an improvement in the use of hot water installations when there are at least two heaters separated from one another, one main heater and another support heater such that the support heater is not activated when it receives cold water while it detects that the main heater has or is generating hot water. In a specific example, applicable to (main) solar heaters which communicate downstream with support heaters (generally electric or fuel), the system measures the temperature reached by the water from the solar panels such that the support heater does not activate when it detects the entry of cold water accumulated only in the section separating both heaters, but rather waits until hot water arrives to it which is already being generated naturally (and more economically) by the solar panels.

Similarly, the invention involves a method of preventive and corrective maintenance of a water supply system, including the part of the installation corresponding to gray water. The system allows the automatic recirculation of hot water when it detects a risk of freezing in the pipes which could cause the same to break. By using the sensors of the system arranged in the installation, this situation can be prevented when it is detected that the water has descended at some point below a determined value. With the same aim of preventive and/or corrective maintenance, the system allows for the dosing of cleaning or corrective substances for their distribution throughout the installation, including the following possibilities amongst others: anti-lime effects, eliminating bad odors, eliminating microorganisms or purifying the chemical and organoleptic properties of the water for consumption. In a specific example of application, this in turn being related to water efficiency: the system allows for the dosing of a substance to one of the modules which they form, situated close to a consumption point, such as a shower and the substance being a substance with determined properties for the toilet such a soap. During one of the operations of the system, the soapy substance dosed to the system is mixed with the flow of water during a consumption step such that the properties of said substance are transferred to the flow of water and used during its consumption. This operation involves a clear advantage when saving water consumed when using the toilet. Normally, during a shower (as a preferable example of use), the user has two options when applying soap: a) leave the hot water running so that it does not turn cold, but, in doing so use more water than is required or b) close the water tap, consuming only the required amount for the subsequent rinsing, but experiencing a drop in their body temperature during this process. This operation allows the user to apply soap with water and as the effect of the dosed substance is ending, the rinsing process is continued automatically. Additionally, the time for applying soap is contingent upon the conditions of the flow of water and the type of substance dosed to the system, therefore, the phase for applying soap can be timed automatically (by calculating the conditions of flow and dosed substance) or activated by the user, meaning a conscious saving of the amount of water required and/or used in said process.

Moreover, the invention proposes a method for utilizing gray water generated in a consumption installation. Specifically, the invention provides for the gray water generated in gray water sanitation device (eminently: toilet, bidet, shower, bathtub or sink) and/or in a storm water collection system to be redirected towards the cistern (or the flushometer) which discharges to a sanitation device generating waste such as a bathroom or urinal by way of the system and the method implemented. The water efficiency of an installation is thereby significantly improved since in an example of a home, the use of these sanitation devices involves a third of the total consumption of water of the installation.

Lastly, the invention allows for the water efficiency of an installation not to depend only on the operation of the system, but on the involvement of the user themselves such that the effect caused by the technology is greater if the user is conscious of the objectives pursued by the same. To this end, the system suggests a series of uses for a database generated from the information compiled by at least one operating water control system and which grows with the addition of information coming from other water control systems of other users. This database is accessible by the user and by other persons and entities authorized for the purpose of statistical and incentivized use of said information. As a specific example, the method of using the database allows a reward system to be established according to a series of conditions of use of the water control system by the user which in the event they are met, opts for the acquisition of this incentive in the form of offers or improvements in their service. Similarly, in pursuit of water efficiency, general information, advice and advertisements are offered to the user by way of the database in order to improve the positive impact of the technology in their installation; for example: with additional advice for saving water. Lastly, the information of this database is also useful for entities managing water resources in a region such that based on this data, they can define use statistics, remodeling, reform or maintenance plans of the infrastructures and, ultimately have more control over them, using experimental information (by actual measured processes, not by statistics) which do not exist today worldwide.

Technologies already exist which have tried to a greater or lesser extent to solve some of these problems without finding one representative of all the uses and with all the characteristics of the described invention.

Document US2010/126604 describes an on-demand hot water distribution system, having some disadvantages. According to the situation described for the temperature sensor in the document, the water will be recirculated throughout the circuit (flow and return lines), not only in the (flow) consumption branch, using, for this purpose, double the energy strictly required for carrying hot water to the consumption point. The technology of this document does not include the possibility of the program and the functions of the same being modified and customized for the user, therefore, the adaptation to each installation will involve different performance and even inefficient performance. According to the document itself, the device carries the hot water to a determined tap and only to said tap, therefore, making the use of a tap connection valve essential for making the effect applicable to all the taps of the installation. Moreover, the operation of the device should be activated only by a tap or determined point, to which the user should move each time they want to use the technology. Similarly, it reflects the need for an activator for each controlled valve. During operation, this system shuts off the recirculation of water according to time and temperature variables, but not pressure, therefore, if a tap is opened during the recirculation, the user will have to wait said determined time for the cycle to conclude, using energy in the operation of the device even when the process is having no effect since the cycle has technically been interrupted by the opening of the tap. According to its operation, it ensures that if the valve is closed, the pump will continue pumping water without any adverse effect, but this is not true since, depending on the power of the pump, the over-pressure caused by being churned without water can cause the failure of other elements of the installation and in the pump itself. This system also does not provide for the pump being primed which, in installations with thermostatic values, generally in installations with solar panels, prevents the water being recirculated correctly since the thermostatic valve will attempt to close the cycle if the water enters through one of its inlets instead of being suctioned from the outlet.

Document ES2378932 defines a water supply system by way of a special tap, having some disadvantages. This device bases its operation on the presence of a special tap at each consumption point where the user wishes to receive the service, not being compatible with existing installation which include normal taps unless said normal taps are replaced with special taps. The electronic control of the device is similarly associated with a specific special tap, creating the pump-tap parity from where its operation is activated at each consumption point of the system, therefore the user must move to said tap in order to activate its use. The system includes a 3-way valve situated in hot water having an outlet towards the cold water and another towards the tap such that, in the event of failure of said valve, the hot water would remain disabled in said tap and/or the hot water would be permanently connected to the cold water.

Document US2010/096018 describes a technology for instantaneous distribution of hot water, having some disadvantages. The operation of this technology is based on the existence of a return branch and a water accumulation reservoir for recirculation to be effective, not being able to be implemented in a traditional installation without a double branch or in instantaneous water heaters or without a reservoir. The system only provides for the shutting-off of the cycle when the water reaches a given temperature without having pressure or operating time sensors or actuators which may cause the cycle to function indefinitely if the water heater is not generating hot water for any reason. The different activators, which the technology can have, are not enabled with notifications of the operating state therefore the user does not know when the cycle starts or ends nor what the outcome is.

Document ES2353414 has a sanitary hot water recirculation device, having some disadvantages. The electrovalve used by this technology, linked to the location of the same, causes the shutting-off of consumption water while the recirculation cycle is active. In this case, the control of the cycle is always timed, pre-programmed by the user and not by other variables such as temperature or pressure, therefore, the user has to predict the times which are required to obtain the water at the suitable temperature without involving any extra energy cost because the cycle would be operating for longer than required. Similarly, each activator is located in proximity to a tap and controlling only said tap, therefore it will be necessary to have both activators and taps so that the hot water arrives to each one of them by means of the method represented.

Document US2004/182439 involves a smart device and system for improving the use of domestic water, having some disadvantages. The system involves the need to interpose a recirculation module at each hot water consumption point of the installation. Moreover, it requires the application of especially modified taps or an external recirculation module, both for each consumption point. In the case of an external recirculation module, it has at least three values for producing the recirculation effect. The system also requires a smart control panel for each tap or external recirculation module. Similarly, another principal limitation essentially involves a tank for storing hot water for producing the desired effect, not being compatible with instantaneous heaters or without a reservoir.

BRIEF DESCRIPTION OF THE INVENTION

The present invention resolves the aforementioned problem by means of a water control system according to claim 1, an installation according to claim 12 and a method according to claim 14. Preferred embodiments of the invention are defined in the dependent claims.

In first inventive aspect, a water control system is defined which comprises five modules, with different and complementary functions, adapted for being coupled to a plumbing installation of a home, premises or building, where the plumbing installation includes a water supply installation and a gray water collection installation. The water supply installation is divided into a branching of at least one hot water branch and at least one cold water branch, where upstream of said branching there is a non-return valve which prevents water introduced returning towards the supply connection. The hot and cold water branches each provide for at least one consumption point to which it arrives by way of a hot water pipe and/or cold water pipe and where by way of at least one tap, the water is discharged towards a drain. The hot water branch, in turn, has a heater with at least one inlet and at least one outlet of water, and which generates hot water for at least one of the following configurations: a) hot water branch for consumption, b) hot water return branch, c) closed hot water circuit for exchange of heat with the environment or another fluid.

The gray water collection installation, as part of the plumbing installation, is where the water collected by the drains of the consumption points which generate gray water, is sent through the gray water pipe towards a pipe for utilizing said gray water directly or indirectly, in this last case, by way of an intermediate gray water accumulator reservoir. Said reservoir has at least three connections including the following: a) at least one water inlet coming from the gray water pipe, b) at least one water inlet coming from the gray water collection pipe, c) at least one water outlet towards the gray water utilization pipe, and/or d) at least one water outlet towards the pipe for draining waste water which is downstream in which said accumulation reservoir comprises means for eliminating water through overflow and/or weight and sediment and/or foam removal means. The at least one gray water utilization pipe connects to a cistern and/or a flushometer which discharges water towards a sanitation device which generates waste water and which is discharged directly to the waste water collection pipe. This sanitation device is where the use of gray water is utilized directly or indirectly, in this last case, connecting the gray water utilization pipe in a connection point with the hot water branch and/or the cold water branch which supply said cistern and/or flushometer.

The control system object of the invention is arranged in this plumbing installation. The control system is modular and comprises a variable amount of at least one module of each type including the following:

a power module which stimulates the circulation of the flow of water. The power module comprises a power supply, a variable flow pumping system, a first electronic control means, at least one sensor, at least one wireless and/or wired signal transceiver and at least one notification means. The power module is adapted for being situated at one of the following points: a) in the hot water branch before the water inlet to the heater, b) in the hot water branch integrated in the heater itself, c) in the hot water branch after the outlet of the water of the heater, d) in the cold water branch, e) in a gray water collection installation in the gray water utilization pipe and/or f) in a gray water collection installation, connected to a gray water utilization reservoir; according to the method of operation of the technology. The pumping power can be regulated manually or automatically. This module is preferably installed in the hot water branch, before the cold water inlet to the water heater or heaters, pumping water through a closed recirculation circuit into the interior of the installation.

a joining module which connects various pipes permanently or temporarily by means of the opening/closing of electrovalves, manual valves and/or motorized valves and which comprises a power supply, at least one valve of at least 2 ways which puts the fluid in connection with at least two pipes when said valve is in the completely open state, at least one sensor, a second electronic control means, at least one wireless and/or wired signal transceiver and notification means. The joining module is adapted for being situated at one of the following points: a) joining at least two points of a cold water branch, b) joining at least two points of a hot water branch, c) joining at least one point of a cold water branch with at least one point of a hot water branch, d) joining at least two points of a gray water installation, e) joining at least one point of a gray water utilization pipe with a point of the water supply installation close to a sanitation device where the gray water is discharged and/or f) integrated in a tap. The valves of the joining module can be opened gradually or on/off. The valves of the joining module can be electrovalves, manual valves and/or motorized valves. In a preferred embodiment, this module has an inlet and an outlet, and is installed connecting a cold water pipe with a hot water pipe or alternatively, two hot water pipes. During the preferably synchronized operation with the power module, the joining module allows the passage of water from one pipe to another, creating a recirculation cycle between the hot and cold water pipes or between hot water pipes, with a minimum of two pipes or connections involved in the process.

an initiator module which activates a determined function and comprises a power source, at least one sensor, a third electronic control means, at least one wireless and/or wired signal transceiver and notification means.

an IoT (internet of things) communication module whose main function is to guarantee communication among the modules wirelessly (boosting the signal) or wired, serving, in addition to the communication link with other external smart elements, as a domotic center or alternative smart network in a physical or virtual environment such as an online platform or software. The IoT communication module configured for repeating the communication signal among modules, comprises a power source, a fourth electronic control means, a wireless and wired signal transceiver and notification means and is configured to communicate with at least one of the following elements: a) another module of the water control system, b) an external sensor, c) an external actuator and/or d) an external control system. In a preferred embodiment, the present IoT communication module enables different types of communication, such as for example by GPRS, connection to a domotic center by cable, Wi-Fi and radio, while the rest of the modules described are only connected to one another or to said IoT communication module by radio. The user can in this case thereby communicate with the system by means of the IoT communication module which, in turn, communicates with the rest of the modules by radio in order to implement the function designated by said user. By means of the present IoT communication module, the control system increases the number and type of possible communications without increasing the total cost.

a control and functional extension module adapted for being installed in the water inlet to the home, premises or building and allowing the physical and chemical variables of the work flow to be managed, including the water inlet to the installation. The control and functional extension module comprises a power source, at least one valve of at least 2-ways, on/off or gradual opening, which is an electrovalve, manual valve or motorized valve and which, in the fully open state, allows the flow of water into its interior, at least one sensor, a fifth electronic control means, at least one wireless and/or wired signal transceiver, notification means and a functional extension bay where control systems of the physical/chemical variables of the water can be coupled such as descalers or water purifiers, is adapted for being installed in any point between the water supply connection of the installation and the branching between at least one hot water branch and at least one cold water branch, including the supply connection itself and the branching itself. This module carries out overall monitoring of the movement of the fluid in the interior of the installation, detecting when consumption is produced and measuring its characteristics.

Each module comprises: i) a physical communication interface with the user by way of at least one button and/or a display and/or a touch screen; ii) notification means of at least one sound, light and/or vibration notifier to show information concerning the operating state of the water control system; iii) an IT program included in the control means for managing the operating programs of the water control system and at least one of the following time variable management elements: a) a clock and/or b) a calendar and/or c) a timer.

By way of the control means and/or the wireless and/or wired signal transceivers, communication is ensured between all the water control system modules, where the operation may be one of the following non-limiting examples: communication by radio on various frequencies, wired communication by power and/or data cable, wired communication by signals emitted and received by the electricity network of the installation itself or communication by optical means.

In one particular embodiment, the control means store the information received by the wireless and/or wired signal transceivers in a memory: a) of the variables measured by at least one sensor and/or b) obtained by external control devices and/or external actuators and/or c) introduced by the physical communication interface with the user.

In one embodiment of the water control system, it comprises at least one visualization means of the information available in the IT program available in at least one of the modules of the system.

In one embodiment, the power source of each module comprises one or various of the following options: a) a power cable connected to the electricity network of the installation, b) an electric energy generator by means of a turbine system and/or solar cells and/or manual mechanism and/or thermoelectric or piezoelectric materials, c) a battery rechargeable by way of its connection to a power cable and to an electric energy generator of those previously described.

The sensors enabled in the water control system preferably measure at least one of the following variables: a) temperature of the fluid, or b) pressure, or c) flow rate, or d) temperature of the environment, or e) humidity of the environment, or f) chemical properties of the water, or g) level of a reservoir or cistern, or h) presence and/or distance, or i) a biometric property. The biometric sensor preferably comprises at least one of the following elements: a microphone for carrying out voice recognition, a camera for carrying out image recognition and a fingerprint sensor for carrying out fingerprint recognition.

The invention has different activation and/or stop conditions which are interpreted: a) by the third control means for initiating the method of operation of the water control system, and b) which are interpreted by the control means of any module for finalizing the method of operation of the water control system and where said activation and/or stop conditions are generated by:

a) a user of the water control system by means of the actuation of: i) an external control device, ii) an element of the physical communication interface with the user, iii) at least one sensor and/or external actuator;

b) the water control system without intervention of the user and automatically, as a response to: i) a preprogrammed time routine in at least one control means according to at least one variable controlled by at least one time variable management element, ii) the information received by at least one sensor, and where the activation and/or stop conditions are received in the third control means directly and/or by the signal transceiver.

With the activation and/or stop conditions known and in the manner of non-limiting examples, the initiator module can have the form of a pulser, a remote control, a domotic mobile or center; the initiator module can be integrated into a tap with two heads, thermostatic or single-lever or another element of the installation.

The presence of different alternatives of activation and/or stop conditions and the fact that those used in stopping the operation of the water control system are accessible from any module, provide the user and the system with different possibilities of operation. At the same time, it means the water control system is less exposed to faults due to internal or external circumstances since either the user by means of the external means of the physical communication interface with the user, or the system itself by means of the different sensors, actuators, external connected devices or time variable management elements, deactivate the water control system in the event that the desired operation of the same is not produced or predicting the appearance of an operational fault.

In one particular embodiment, the water control system is characterized in that the joining module and/or the control module comprises a repository accessible to the user for introducing liquid/solid substances which are mixed with the flow of water during operation, in which said repository is controlled by at least one valve such that: in a first position, said valve connects said repository to the at least one pipe of the installation through which the water circulates through the joining and/or control module, creating a fluid with properties modified by the substance from where the at least one joining and/or control module is installed to a determined consumption point when it is open and preventing the opening of the repository to dose substances; and in a second position, said valve allows for the dosing of the substance modifying the properties of the water to the repository while said repository is not connected to the flow of water of the at least one pipe which passes through the joining and/or control module, ensuring by means of the valve that the flow of water passing through the affected module does not leave through the repository when it is operated by the user.

As non-limiting examples; the substance to be distributed is liquid or solid introduced directly into the repository or in capsules and contains anti-lime, disinfectant, biocidal, cleaning properties, properties for reducing the amount of chlorine or any other type of substance whose effect is intended to be distributed in the network of pipes.

In one particular embodiment, where the water control system has at least one repository for dosing substances modifying the properties of the flow, the stop means include at least one of the following conditions: a) the perception by the user of the finalization of a specific operation owing to the complete dilution of a substance modifying the properties of the flow in the water, b) the measurement of the complete dilution of a substance modifying the properties of the flow in the water by means of at least one sensor of the chemical properties of the water.

In one particular embodiment, the control module comprises a secondary pumping system.

In one particular embodiment, the control module is integrated as part of an external control or monitoring system of the flow of water and/or a water treatment system in at least one of the following options: a) a controller, b) a flow rate and/or pressure regulation system, c) an anti-lime system, d) a filtering system or e) a system for purifying water for consumption.

The power modules can be grouped and coupled together in series or in parallel, consequently increasing the working flow rate and/or pressure of the fluid, depending on the number of operating modules.

In one particular embodiment, the power module is installed at the suction side of hot water. Advantageously, this embodiment allows for, in the event of various heaters whose arrangement is unknown, the module to be installed at the outlet of the last of these heaters, suctioning hot water towards the consumption network, independently of the number of heaters and their distribution (in series or parallel) with the last heater. Additionally, in order to extend the life of the power module, it can have a bypass line parallel to the module, enabled by means of a valve such that during the operating cycle, the water circulates through the power module and during the consumption cycle, the fluid circulates through the alternative bypass line, reducing the operating time of the module with hot water.

In a second inventive aspect, the plumbing installation includes a water supply installation and a gray water collection installation, the water supply installation comprising a supply connection, a general pipe, a branching point in which the general pipe is branched towards a hot water branch and a cold water branch, a non-return valve situated upstream of the branching point, a water heater having at least one inlet and at least one outlet, situated in the hot water branch and at least one cold and/or hot water consumption point, having at least one tap and cold pipe arriving to each one of them coming from the cold water branch and/or hot pipe which comes from the hot water branch and the gray water installation comprising a drain through which the water arrives from a consumption point, a gray water pipe which connects downstream to a gray water utilization pipe, characterized in that it comprises a water control system according to any of the preceding claims where the hot water branch of the water supply installation comprises at least one water heater and at least one of the following:

a) at least one hot water pipe for the consumption of hot water, b) at least one hot water pipe for the return of hot consumption water and/or c) at least one closed recirculation pipe for heating a space and/or other fluid;

and where the gray water collection installation comprises at least one gray water pipe coming from at least one drain of a consumption point and at least one of the following elements:

a) an additional gray water utilization pipe which connects the gray water pipe, in at least one connection point, to at least one cold and/or hot water branch point and/or another reservoir or cistern or flushometer for the draining of gray water in a sanitation device; and which comprises a non-return valve to avoid the draining of water of the supply installation into the gray water collection installation, b) a gray water accumulation reservoir, accessible by the user which connects to at least three joining points including the following: i) at least one inlet of a gray water pipe connected to the drain of the consumption point, ii) at least one inlet of a gray water pipe connected to a gray water collection system not coming from a consumption point, iii) at least one outlet towards an additional gray water utilization pipe for directly or indirectly draining gray water into the sanitation device and iv) at least one outlet towards a gray water pipe connected to a waste water drain pipe which is downstream, wherein said accumulation reservoir comprises water removal means by overflowing and/or weight and sediment/foam removal means.

In one particular embodiment, the water supply and/or gray water utilization installation comprises, before and/or after each element connected to the plumbing network of the installation: a) modules of the system, b) external sensors in communication with the system or c) external actuators in communication with the system; at least one filter and at least one of the following: a) a flow shut-off valve, b) a non-return valve, c) a pressure regulating valve and/or d) an air discharge valve for maintaining the system and/or the replacement of elements in the event of a fault.

Advantageously, the pressure sensors, upon detecting a drop in differential pressure between the inlet and the outlet of a module and/or between specific sections of the water supply and/or gray water installation, allow the user to localize points of pressure drops so that it can be reviewed and/or maintained; as non-limiting examples: the cleaning or replacement of the particle filters, pipe sections or elements of valves which are obstructed or the localization of leaks in the installation.

In a third inventive aspect according to the invention, the invention includes a method of operation of a water control system according to a first inventive aspect for being installed in an installation according to the second inventive aspect, the method characterized in that it comprises the steps of:

a) proceeding from a water control system whose modules are in the rest state, the third control means receives an activation and/or stop condition, generated by a user or by the water control system itself automatically; which means the change of state of the water control system from rest to operation, b) the third control means processes the received condition, determining the action to be executed in each module, c) the initiator module executes the action determined by its control means and sends, by means of the signal transceiver, a signal to each module with information of the action which each module should execute and in parallel sends initiating signals of the method of operation by way of the notification means, d) each module of the system receives the original signal from the initiator module by way of its signal transceiver, being processed by its control means and executed by the at least one controlled element of: a pumping system, a valve, a sensor, an external actuator, an external control device or the element coupled in the functional extension bay, e) by way of the notification means, the at least one module reflects the receipt of the information and the initiation of the method of operation and sends, by way of the signal transceiver, a return signal to the initiator module so that it initiates the operation which is maintained, by way of the controlled elements, until at least one new activation and/or stop conditions is detected which returns the modules to the rest condition, f) when an activation and/or stop condition is identified in at least one control means, said control means interrupts the operation of its controlled element, sending a signal to the rest of the modules by means of the signal transceiver and sending signals of the finalization of the method of operation by way of the notification means, g) the detection signal of an activation and/or stop condition is received by the rest of the modules, which interrupt the operation of their control elements, sending signals of the finalization of the method of operation by way of the notification means and sending a signal with information indicating the availability of the water control system for an operation restart to the third control means by means of the signal transceiver, h) the information of the executed method of operation is stored in a database of at least one control means, the modules remaining in their original rest state awaiting a new activation and/or stop condition.

In one particular embodiment, the method of operation of a water control system comprises, prior to step a), at least one of the following phases: i) a prior identification process by means of at least one biometric sensor and/or an element of the physical communication interface with the user, as a non-limiting example, by way of a password introduced, and/or ii) the dosing of a substance by the user in one of the repositories of the joining and/or control module respectively, or in the functional extension bay of the control module.

Advantageously, the prior identification allows the automatization and/or customization of the operating parameters to each individual, in addition to limiting the action or determined functions to specific users.

In one particular embodiment of the method of operation of a water control system, for preheating the water in the hot water branch prior to consumption by means of recirculation, when activation and/or stop conditions are detected in the initiator module:

in step d): the joining module changes the state of at least one valve from closed to open, connecting said at least two pipes and the power module initiates the movement of its pumping system, causing the recirculation of water through the heater from the affected power module to the at least one affected joining module in a closed circuit, in step e): maintaining the operation until at least one new activation and/or stop condition is detected: a) the detection by way of at least one sensor in at least one power and/or joining module of a temperature and/or pressure of the water and/or determined operating time or b) the activation in any of the modules of an external stop means in the physical interface with the user;

in step f) the process stops, the power module stops the movement of the pumping system and the at least one valve of the at least one affected joining module changes its state again from open to closed.

Advantageously, this allows the method of operation to cause the recirculation of cold water through the pipes, pumping hot water from the heating point of the hot water branch, towards the point where the joining module is installed, notifying the user by means of the notification means when the activation and/or stop condition has been produced. The user thereby has hot water without having to waste cold water in the process since this cold water had been cooled in the hot water pipe after the last use, passes through the joining module, returns to the cold water circuit in the opposite direction, being replaced by the hot water which comes from the heating system of the installation.

In one particular embodiment of the method of operation, the operating process includes at least one IoT communication module and at least one external sensor for measuring the temperature of the water. In one particular application, when the water is heated by solar panels (on the exterior of the home or premises) and addition heating by a support system (in the interior of the home or premises), which is automatically activated when it detects that the input water (which in turn comes from the hot water outlet of the solar heater); the support heater starts to operate provided it detects the cold input water while the hot water arrives from the solar panel. Using an external temperature sensor which measures the water in the interior or immediately at the outlet of the solar heater, the unnecessary actuation of the support heater is prevented.

Advantageously, this particular embodiment prevents situations of inefficient activation of support heaters in installations which have at least two heaters separated from one another, with special relevance in heaters supplied by renewable energy.

In one particular embodiment of the method of operation of a water control system for preventing damage with respect to freezing:

in step a): the detection of at least one activation and/or stop condition of the initiator module is automatic and involves measuring at least one sensor of at least one power module and/or at least one joining module of a temperature of the water equal to or less than a value established in at least one control means, in step d): the joining module changes the state of at least one valve from closed to open and the power module initiates the movement of its pumping system, causing the recirculation of water through the heater from the power module to the at least one joining module, in a closed circuit, in step e): maintaining the operation until at least one activation and/or stop condition is detected from among: a) the detection by way of at least one sensor in at least one power and/or joining module of a temperature and/or pressure of the water and/or determined operating time or b) the activation in any of the modules of an external stop means in the physical interface with the user;

in step f): time at which the process stops, the power module stops the movement of the pumping system and the at least one valve of the at least one joining module changes its state from open to closed again.

Advantageously, the method of operation causes the recirculation of hot water in the interior of the pipes when there is a risk of freezing the water in its interior, avoiding serious and irreversible damage in installations, by raising the temperature of the same.

In one particular embodiment of the method of operation of a water control system, for analyzing and preventing the proliferation of bacteria:

in step a): the detection of at least one activation and/or stop condition of the initiator module is generated automatically by means of at least one time variable management element from a clock and/or a calendar in step d): the joining module changes the state of at least one valve from closed to open and the power module initiates the movement of its pumping system, causing the recirculation of water through the heater from the power module to the at least one joining module, in a closed circuit, in step e): maintaining the operation until at least one activation and/or stop condition is detected from among: a) the detection by way of at least one sensor of a joining module of a temperature of the water upon arrival to at least one consumption point and/or determined operating time used in the process by means of at least one time variable element from among: a clock and/or a timer in at least one of the modules or b) the activation in any of the modules of an external stop means in the physical interface with the user;

in step f): time at which the power module stops the movement of the pumping system and the at least one valve of the at least one joining module changes its state from open to closed again.

Advantageously, the method of operation prevents the risk of uncontrolled proliferation of the *Legionella* bacteria in sanitary installations of hot water for consumption, with the aim of maintaining the proliferation risk parameters of said bacteria at salubrity values by means of control evaluations. These control evaluations consist of checking that each certain period of time (for example: each day): the water at the outlet of the water heater is above a given temperature and that the water arrives to a consumption point in a specific time and at a determined temperature.

In one particular embodiment of the method of operation, analysis and prevention of the proliferation of bacteria, the method of operation also uses at least one control module, where said control module injects biocidal substances from its repository into the installation during the operation of the water control system.

Advantageously, this particular embodiment extends the range of possibilities for protection against *Legionella* and other potentially toxic bacteria and/or microorganisms.

In one particular embodiment of the method of operation of a system for controlling water, managing heating and/or recirculation networks:

in step a): the detection of at least one activation and/or stop condition of the initiator module is generated automatically by way of the measurement of at least one sensor of at least one power module, installed in a hot water branch, of a temperature, of the fluid and/or environment, equal to or less than a value established in at least one control means and/or by means of at least one time variable management element from a clock and/or a calendar, in step d): the power module initiates the movement of its pumping system, involving the recirculation of water through the heater from the power module and throughout the installation, in a closed circuit, in step e): maintaining the operation until at least one activation and/or stop condition is detected from among: a) the detection by way of at least one sensor of at least one power module of a temperature of the water and/or an environmental temperature and/or a determined operating time used in the process by means of at least one time variable management element from: a clock and/or a timer in at least one of the modules or b) the activation in any of the modules of an external stop means in the physical interface with the user;

in step f): time at which the process stops, the power module stops the movement of the pumping system.

Advantageously, this particular embodiment describes a method of control over heating systems consisting of pipes filled with heat-carrying fluids (water or others) in a closed circuit, including sanitary hot water return circuits by means of a parallel or concentric double branch such that the user can manage the environmental conditions of their own home or premises and/or preheat the water before consumption by means of an installation with a return.

In one particular embodiment of the method of operation of a system for controlling water, for modifying the properties of the fluid for consumption and/or maintaining the installation in an open circuit, characterized in that, in a phase prior to operation, the user introduces a determined substance in:

a) at least one control module, by way of the repository and/or b) at least one joining module, where at least one joining module is in accordance with a particular embodiment and includes a repository where a determined substance is introduced, and in that when at least one activation and/or stop condition of at least one initiator module is detected:

in step d): the joining and/or control module puts the substance of the repository in contact with the flow of water, by means of the use of at least one valve when the flow of water is activated at a consumption point, in step e): maintaining the operation until at least one new activation and/or stop condition is detected or the user notifies that the effect of the substances introduced into the flow of water has stopped, in step f): returning the at least one actuated valve to its original position, interrupting the fluid communication between the repository and the consumption flow.

Advantageously, this particular embodiment causes the modification of the parameters of the work flow in an installation such that it is: a) more suitable for human consumption, b) has special properties for the toilet and/or c) it allows the integral maintenance of a plumbing installation by means of the use of cleaning or preservation products which circulate through the interior of the pipes where the effect is desired, in closed or open circulation up to the consumption point.

Advantageously, the method of operation allows the water for consumption to leave with the properties inherent to the substance contained in the repository for a time determined by the characteristics of the flow and of the dosed substance, until it is completely diluted. This condition involves a clear advantage when saving water during consumption when using the toilet. Normally, during a shower (such as for example preferably during use), the user has two options when applying soap: a) leave the hot water running so that it does not turn cold, but, in doing so use more water than is required or b) close the water tap, consuming only the required amount for the subsequent rinsing, but experiencing a drop in their body temperature during this process. This method of operation in its particular embodiment using the joining module for the dosing of substances modifying the properties of the flow allows the user to apply soap with water and as the effect of the added substance is ending, the rinsing process is continued automatically. Additionally, the time for applying soap is contingent upon the conditions of the flow of water and the type of substance dosed in the repository, therefore, the phase for applying soap can be timed automatically (by calculating the conditions of flow and dosed substance) or activated by the user, meaning a conscious saving of the amount of water required and/or used in said process.

In the event that the substance to be used is not suitable for human consumption:

in step g) the water control system notifies by way of available notification means of the need to rinse the pipes of the content used, replacing said volume with fresh water coming from the supply connection.

In one particular embodiment of the method of operation, the effect of a substance introduced into at least one module with a repository is reproduced by an external device for water treatment connected to the water control system by way of the functional extension bay.

In one particular embodiment of the method of operation of a system for controlling water, modifying the properties of the work fluid and/or maintaining the installation in a closed circuit, characterized in that, in a phase prior to operation, the user introduces a determined substance into at least one joining module, where at least one joining module is in accordance with a particular embodiment and includes a repository where a determined substance is introduced, and in that when at least one activation and/or stop condition of at least one initiator module is detected:

in step d): the joining module puts the substance of the repository in contact with the flow of water, by means of the use of at least one valve when the flow of water is activated at a consumption point and the power module initiates the operation of its pumping system moving the water with properties modified by means of the substance dosed in the repository of the joining module, in a closed circuit through the installation, in step e): maintaining the operation until at least one new activation and/or stop condition is detected, in step f): returning the at least one actuated valve to its original position, interrupting the fluid communication between the repository and the consumption flow and stopping the pumping system of the power module.

Advantageously, this particular embodiment of the method of operation causes the recirculation in at least one closed circuit of the installation, of a fluid modified for maintaining the installation in operation, such as non-limiting examples of: cleaning pipes and detecting leaks by means of a fluorescent fluid.

In one particular embodiment of the method of operation of a system for controlling water, utilizing gray water in a gray water installation, characterized in that at least one power module is installed in one point of the gray water collection installation in:

a) the additional gray water utilization pipe and in that it is connected to: a) the cistern or flushometer of the sanitation device which discharges the gray water or b) a connection point of the water supply installation which, in turn, is connected to the cistern or flushometer of the sanitation device which discharges the gray water, b) connected to the gray water utilization reservoir;

and where given at least one activation and/or stop condition in the initiator module, preferably by means of a level sensor in the cistern of the sanitation device where the gray water is intended to be utilized and/or by means of a flow rate sensor which detects the flow in the gray water pipe and/or by means a pressure sensor in the water discharge pipe to the sanitation device where the gray water is intended to be utilized, in step d): the power module activates the pumping system, in step e): the gray water discharged by at least one drain towards the additional gray water utilization pipe and/or towards the reservoir are pumped by the power module, circulating through the additional gray water utilization pipe for its use in another sanitation device, maintaining the operation until at least one new activation and/or stop condition is detected from among: measuring at least one flow rate and/or pressure sensor in at least one of the modules and whose value is contrasted with at least one control means under whose criterion, including the measuring of time variables, in step f): the operation concludes, interrupting the movement of the pumping system of the power module.

Advantageously, this particular embodiment of the method of operation generates notable utilization of water in a plumbing installation, avoiding wastage of potable water when emptying a toilet cistern and utilizing to this end gray water discharged by nearby sanitation devices. The operation is preferably automatic without the need for user intervention.

Advantageously, the use of a gray water utilization reservoir guarantees that when the power module enters into operation, there is a determined amount of water which transfers to the cistern.

In one particular embodiment of the method of operation, there is at least one joining module installed in at least any of the locations possible for the power module and which, by means of the opening/closing of its at least one valve, allows or interrupts the passage of water towards the gray water utilization pipe.

In one particular embodiment of the method of operation, the sanitary installation which generates waste water uses flushometer type mechanisms for toilets, urinals and similar. These types of installations allow for the discharge of pressurized network water directly via the sanitation device during a determined time. Taking the particular case of the additional gray water utilization pipe which connects to the cold water tap in a branching prior to the discharge to the cistern, where a valve or joining module is installed upstream of said branching; it is considered that the final discharge section to the sanitation device is initially empty and the valve or joining module impedes the passage of water towards said final section which is close at its end, therefore, allowing occupation by a volume of water determined by the diameter and length of this section. During operation of the system, this originally empty section and preferably with the same volume as the amount of water discharged during the actuation of the flushometer, will be filed with gray water due to the effect of the power module, until a rise in pressure is detected (which indicates that the section of pipe has been filled). Once the section is full and the flushometer is activated, the user opens the valve or, the joining module automatically opens and allows the connection to the supply installation as a response to the drop in pressure caused by the flushometer such that the pressurized cold water from the network pumps the gray water which has filled the section of pipe closest to the drain. Before the flushometer shuts off the passage of water completely, the user closes the valve, or the joining module automatically changes its state again to closed, leaving the remaining cold water to leave at the last moments of the action of the flushometer and the final section returns to being empty (or starts to refill with gray water if it is available).

In one particular embodiment of the method of operation of a system for controlling water, notifying and blocking undesired consumption of water, given at least one activation and/or stop condition of at least one initiator module:

in step a): the control module detects, by way of at least one flow rate and/or pressure sensor, if there is a flow of water which, with respect to the information contained in at least one control means, is considered undesirable. As non-limiting examples: i) water consumption when there are no users in the installation (a condition which is communicated by the user to the water control system by means of the physical communication interface with the user of by means of an external control device), ii) prolonged consumption of water with respect to an established time, iii) consumption of water according to consumption rules established by at least one control means or iv) inlet condition to the installation measured by at least one water pressure and/or temperature sensor which are different to those established as salubrity rules the information available by way of at least one control means;

in step c): the system executes at least one of the following actions:

a) shows a clear notification signal of this condition by way of the available notification means, b) sends, by way of the wireless and/or wired notification signal transceiver, information of this condition to an external control device, in step d): by way of interaction of the user directly by way of the physical communication interface with the user or indirectly by way of the external control device (responding to the notification signal: accepting or rejecting the consumption) and/or automatically according to consumption and time variables processed by at least one control means (if the user does not respond to the notification signal), the control module a) changes the state of at least one valve of its interior from open to closed, impeding the passage of water through this valve towards the water supply installation if the consumption is rejected by the user or if they do not respond to the notification signal within a maximum determined time or b) it does not change the state of the at least one valve (if the consumption is accepted), allowing the passage of the supply to its interior.

Advantageously, this particular embodiment of the method of operation of a water control system has a method for detecting and avoiding the undesired consumption of water in an installation when the user leaves the same or if it is unnoticed, caused by damage in the same such as leaks, breakages, impacts and other failures in the installation. The damage caused to the installation is thereby limited to the volume of water found within the pipes at the time of generating the notification signal and its consequent response.

In one particular embodiment of the method of operation, by way of the IoT communication module, notification is given to external emergency means that there is a fault in the installation. In a particular case of a user having home insurance, the system thereby sends the notification signal due to undesired consumption to said contact, according to a program approved by the user or by the insurer themselves such that they can intervene to resolve the detected fault. Similarly, these salubrity contacts to which the salubrity notification is sent are: neighbors, property managers, relatives, friends or firefighters, among other possible contacts.

In any of the methods of operation which include recirculation, the activation and/or stop conditions originate from a pressure sensor and/or pressure switch such that when a drop in pressure greater than the pressure caused by the pumping system of the power and/or control module is detected, inherent to the opening of a tap, which involves a drop in pressure from the network pressure to atmospheric pressure, the recirculation circuit is interrupted since: a) the network pressure is greater than that caused by the power and/or control module and the water of the cold water pipe cannot flow in the direction opposite to that of consumption and/or b) the depression caused redirects the direction of the work flow from the inlet to the open consumption point, independently of the programmed operating circuit. If a recirculation cycle is being produced, a tap is opened, this condition is detected by the pressure sensor or pressure switch, creating an activity stop signal in the water control system which change the state in which they were from return to their original state.

Advantageously, this last particular embodiment allows energy to be saved during the recirculation process when it is being interrupted by the opening of a tap, avoiding said process being maintained until the activity stop condition due to time.

In one particular embodiment of the method of operation, in at least one of the operating steps, at least one IoT communication module is used which connects the water control system to the at least one external sensor and/or an external actuator and/or external control means and where the information measured, sent and/or received by at least one of these external elements is used as an activation and/or stop condition.

In one particular embodiment of the method of operation, in at least one operating step, a sensor for measuring environmental variables is used such that it is used as an activation and/or stop condition, any of the functions with special relevance to those relating to the comfort of the user (example: heating) or the prevention of extreme working temperatures (for example: danger of freezing).

In one particular embodiment of the method of operation, characterized in that the method of operation also uses: at least one power and/or joining and/or control module which: a) intervenes in the generation of at least one activation and/or stop condition and/or b) compartmentalizing the application of the method of operation in a specific section of the installation by means of the opening or closing of at least one valve and the activation or deactivation of at least one pumping system.

Advantageously, the installation of at least one additional joining module in an intermediate point of an installation operating in closed circuit allows the scope of recirculation functions to be compartmentalized so that they cover only the sections enabled according to the activation of the at least one valve of said at least one additional joining module. In one particular case, a double branch installation which covers the entire floor of a building has half of said coverage, with a joining module connecting two parts of the flow pipe with a part of the network return. During the original recirculation operation according to the double branch, the water covers the entire floor in both directions. In the case of the installation of the joining module in half of said coverage and during the operation of the water control system in one particular embodiment, a new flow and return connection is enabled midway such that the cycle shuts off midway. This function allows the time and energy used in the cycle to be reduced. In one example of application: if in a hotel with a hot water branch which distributes to the rooms 1 to 10, the last rooms (6 to 10) are not occupied, it is not necessary for the recirculation cycle to reach said rooms, but rather it is preferable for it to reach only those which are going to use hot water (1 to 5). In this specific example, half the time and energy is saved in the cycle in proportion to the reduced path.

Advantageously, the installation of at least one additional joining module allows additional control lines of the flow to be established so that it is forced to pass or not to pass through certain elements of the installation, protecting them from wear. In one particular case of application of the operation of the water control system during the recirculation for the preheating of hot water before consumption, when the power module is situated suctioning hot water from the water heater, an additional pipe parallel to said heater is adapted; where said parallel pipe has an additional joining module such that two alternative paths are created for the water a) either it passes towards the support heater or b) it circulates through said parallel line without entering the support heater. Therefore, during operation, the hot water will inevitably pass through the power module such that when the operating process ends and the water consumption starts, the alternative flow line, parallel to the power module is enabled, therefore, during the consumption of hot water, this hot water does not pass through the power module, but through said alternative flow line, increasing the service life of the power module.

In one particular embodiment, all the modules of the invention are supplied by internal and/or removable and rechargeable batteries. Advantageously, this allows them to be installed in humid environments where the presence of electric wires is not allowed by law. At the same time, it allows for operation even when there is no electric power in the network, for example during a blackout.

In a fourth inventive aspect, the invention generates a database collected and stored by the different installed modules of the system. The data make reference to different variables of the installation, the installed device, the user, the water consumption and its composition and properties, for non-limiting purposes: information collected by the sensors concerning consumption flow rates, temperatures and pressures in each controlled pipe, collected by the time variable management means during different time intervals, classified by user or type of installation.

The experimental database created by the information compiled by the control means of the water control system is sent by means of the IoT communication module by way of the wireless and/or wired signal transceiver towards an external control device and/or information management platform, where the information of each active water control system is stored, the characteristics of the system and its application in the installation, the use routines of hot and cold water and gray water, the water efficiency produced by the system, information of the user and type of installation and managed by big data tools and neuronal networks.

In a fifth inventive aspect, the invention provides an information and incentivisation method for the responsible consumption of water and, consequently, the water efficiency of the controlled installation.

This information and incentivisation method for the responsible consumption of water used, as a basis, information compiled by the control means of the water control system where the data are anonymized and accessible fully and/or in a limited manner: a) by the user by way of at least one visualization means of the system or by means of an external control device, b) by manufacturers and technicians of the water control system for planning and resolving technical incidents and incidents related to the installation, maintaining and preventing errors, c) by manufacturers and sales representatives of the water control system for statistical research and to improve commercial application, d) the companies and administrations who intervene in the construction process, urban planning and water resource management such that they obtain new information concerning the consumption of water to plan the distribution of resources and plan improvements and solutions in smart city models, e) the companies and administrations for research into areas related to the nature and objectives of the invention, f) the companies and administrations who participate in the gamification model of water efficiency.

In one particular embodiment of the information and incentivisation method for the responsible consumption of water, there is a gamification model for the incentivisation of the use of the water control system in the pursuit of improving the water efficiency of the user and/or the installation based on the fact that the companies and/or the administration send general conditions given for achieving incentives coming from the experimental database to the management platform of the information, directed at least at one user and/or group of users where said general conditions include at least: a) consumption conditions and/or b) installation conditions given that they are visualized by each user by way of at least one visualization system which the water control system includes and/or by way of a connected external control device such that if the user and/or an installation meet the conditions required for the incentives described by said companies and/or administration, they can obtain an incentive or advantageous offer ultimately awarded by a) a draw among user and/or installations meeting said conditions, b) timed order of meeting said conditions, c) value in meeting said conditions, d) another rule designating awarding of the incentive included in the management platform of the information and which is notified to the user by means of the visualization means of the water control system and/or by means of a connected external control device and notified to the company and/or administration awarding the incentive by communication by way of the management platform.

In one particular embodiment of the information and incentivisation method for the responsible consumption of water, the manufacturer and other authorized entities send information to the user concerning how to improve the water efficiency of their installation by means of the visualization means of the water control system and/or by means of a connected external control device.

Advantageously, the information and incentivisation method for the responsible consumption of water is characterized by the improvement of the quality of life and the environmental awareness of a user and the water efficiency of a contrasting installation based on parameters measurable by the water control system and by means of surveys or other communications carried out by way of at least one visualization means of the water control system and/or connected external control device.

Advantageously, the visualization by the user of all the water usage variables: flow rate, temperature, pressure or consumption of hot and cold water, amongst other variables represented in real time and historically in periods, together with the signals emitted by the notification means; light, sound and/or vibration in the module itself or by way of the external devices with which it is connected, when determined values are reached in the measured or calculated variables based on these, they have a greater impact on saving and water and/or energy efficiency of the invention, as it makes the user participate in its operation and advantageous effects, changing their water usage habits to more sustainable and ecological daily routines, improving their environmental awareness. Moreover, the user can control and modify the operating parameters of each module to create their own consumption scenario for each room, tap, consumer, time, day or season of the year, among other parameters.

All the characteristics and/or steps of the methods described in this specification (including the claims, description and drawings) can be combined in any combination, except combinations of such mutually exclusive characteristics.

DESCRIPTION OF THE DRAWINGS

These and other characteristics and advantages of the invention are found in the detailed description of a preferred embodiment, given only by way of illustrative and non-limiting example, with reference to the enclosed figures.

DETAILED DESCRIPTION OF THE INVENTION

Figure 1:
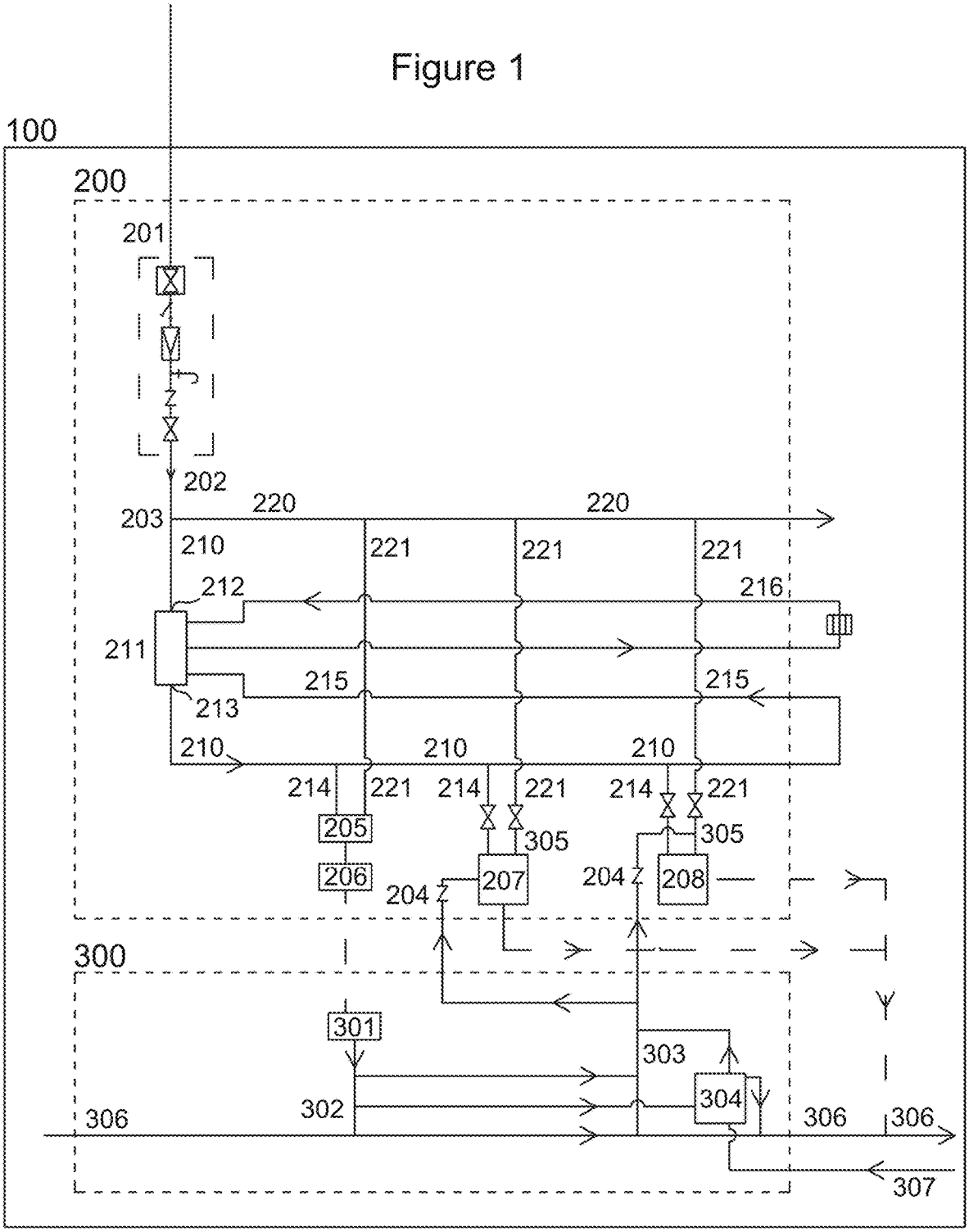
FIG. 1 Plumbing installation which includes a water supply installation and a gray water installation provided with a water control system according to the installation possibilities described in the invention.

A plumbing installation (100) is shown in FIG. 1 formed by a water supply installation (200) where the water is introduced into the supply installation (200) from a supply connection (201) by way of a general pipe (202). Said water supply installation (200) is divided in a branching (203) into at least one hot water branch (210) and at least one cold water branch (220) where upstream of said branching (204) there is a non-return valve (204) which prevents water introduced returning towards the supply connection (201). The hot (210) and cold (220) water branches each provide for at least one consumption point (205) to which it arrives by way of a hot water pipe (214) and/or cold water pipe (221) and where by way of at least one tap (206), the water is discharged towards a drain (301). The hot water branch (220), in turn, has a heater (211) with at least one inlet (212) and at least one outlet (213) of water, and which generates hot water for at least one of the following configurations: a) a hot water consumption branch (210), b) a hot water return branch (215), c) a closed hot water circuit (216) for exchange of heat with the environment or another fluid.

FIG. 1 also shows a gray water collection installation (300) as part of the plumbing installation (100), where the water collected by the drains (301) of the consumption points (205) which generate gray water, is sent through the gray water pipe (302) towards a pipe for utilizing said gray water (303) directly or indirectly, in this last case, by way of an intermediate gray water accumulator reservoir (304). Said reservoir (304) has at least three connections including the following: a) at least one water inlet coming from the gray water pipe (302), b) at least one water inlet coming from the gray water collection pipe (307), c) at least one water outlet towards the gray water utilization pipe (303), and/or d) at least one water outlet towards the pipe for draining waste water (306). The at least one gray water utilization pipe (303) connects to a cistern (207) and/or a flushometer (208) which discharges water towards a sanitation device which generates waste water (306). This sanitation device is where the use of gray water is utilized directly or indirectly, in this last case, connecting the gray water utilization pipe (303) in a connection point (305) with the hot water branch (220) and/or the cold water branch (210) which supply said cistern (207) and/or flushometer (208).

The water control system (1) is formed by at least five modules (10, 20, 30, 40, 50) where there is at least one module of each type from: a power module (10), a joining module (20), an initiator module (30), an IoT communication module (40) and a control module (50). Each one of these modules is installed in a different location of the plumbing installation (100), in the water supply installation part (200) and/or the gray water collection installation part (300).

The power module (10) is installed in one of the following points of the water supply installation (200) and/or gray water collection installation (300): a) in the hot water branch (210) before the water inlet to the heater (212), b) in the hot water branch (210) integrated in the heater itself (211), c) in the hot water branch (210) after the outlet of the water of the heater (213), d) in the cold water branch (220), e) in the gray water utilization pipe (303) and/or f) in the gray water utilization reservoir (304).

The joining module (20) is installed in one of the following points of the water supply installation (200) and/or the gray water collection installation (300): a) joining at least two points of a cold water branch (220), b) joining at least two points of a hot water branch (210), c) joining at least one point of a cold water branch (220) to at least one point of a hot water branch (210), d) joining at least two points of a gray water installation (300), e) joining at least one point of a gray water utilization pipe (303) to a point of the water supply installation (200) in proximity to a sanitation device where the gray water is discharged and/or f) integrated into a tap (206).

The initiator module (30) and the IoT communication module (40) are not connected to the plumbing, but control it and can be installed close to any installation point (200, 300): near to one of the other modules of the water control system (1) or in a location separated from the same; or even at a point external to the installation itself (200, 300) but in communication with the rest of the modules, exercising effective control over the installation (200, 300). The initiator module (30) and/or the IoT communication module (40) can be fixed in one location or be movable and portable by the user.

The control and functional extension module (50) is installed at any point between the supply connection (201) of water of the supply installation (200) and the branching (203) between at least one hot water branch (210) and at least one cold water branch (220), including the supply connection (201) itself and the branching (202) itself.

Figure 2:
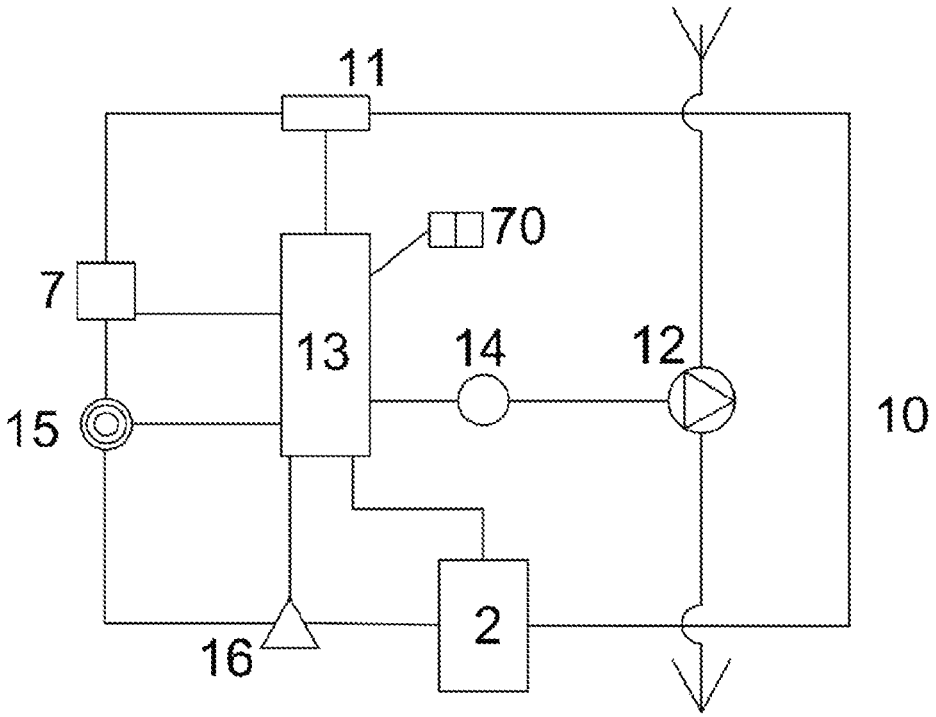
FIG. 2 Preferred plan of the power module according to the invention.

FIG. 2 represents a preferred example of a power module (10) according to the invention. This module comprises a physical communication interface with the user (2), a power source (11), a variable flow rate pumping system (12), a first electronic control means (13), at least one sensor (14), at least one signal transceiver (15) and notification means (16).

Figure 3:
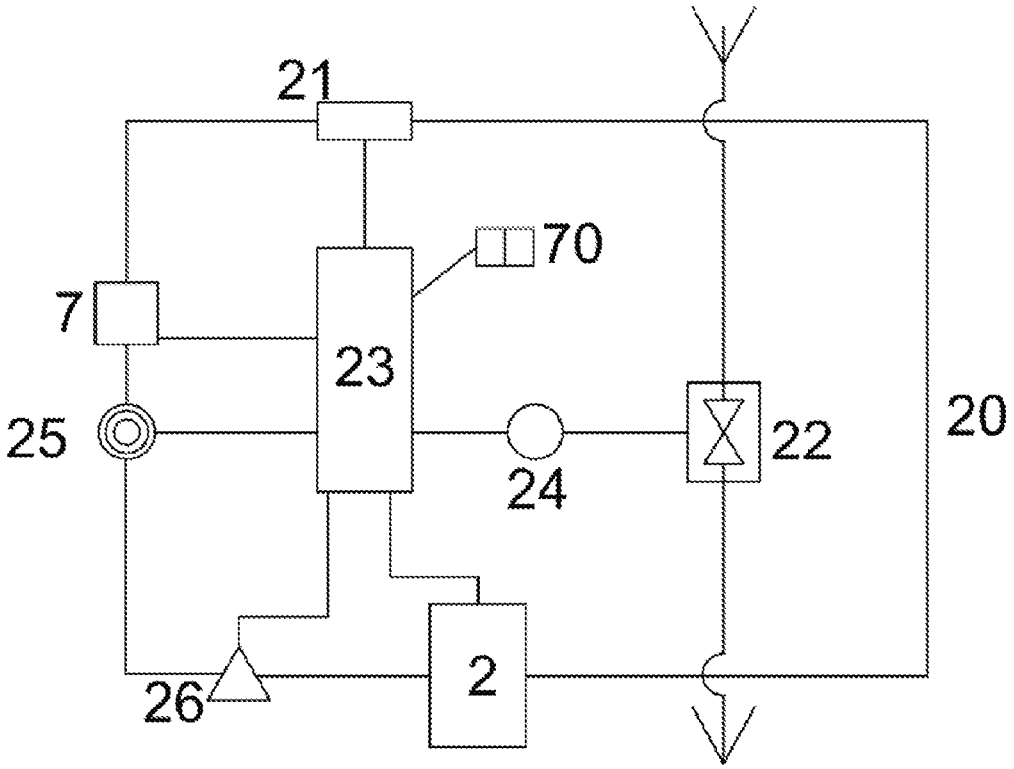
FIG. 3 Preferred plan of the joining module according to the invention.

FIG. 3 represents a preferred example of a joining module (20) according to the invention. This module comprises a physical communication interface with the user (2), a power source (21), at least one valve (12) of at least 2-ways which puts at least two pipes in fluid communication when said valve (22) is in the completely open state, a second electronic control means (23) at least one sensor (24), at least one signal transceiver (25) and notification means (26).

Figure 4:
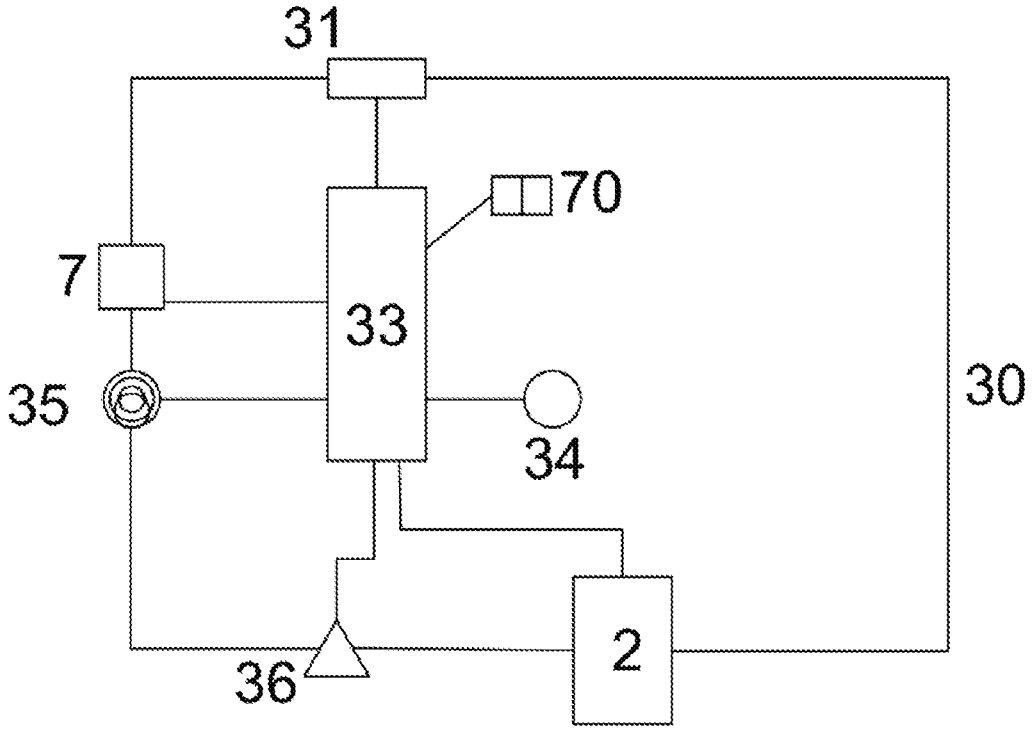
FIG. 4 Preferred plan of the initiator module according to the invention.

FIG. 4 represents a preferred example of an initiator module (30) according to the invention. This module comprises a physical communication interface with the user (2), a power source (31), a third electronic control means (33), at least one sensor (34), at least one signal transceiver (35) and notification means (36).

Figure 5:
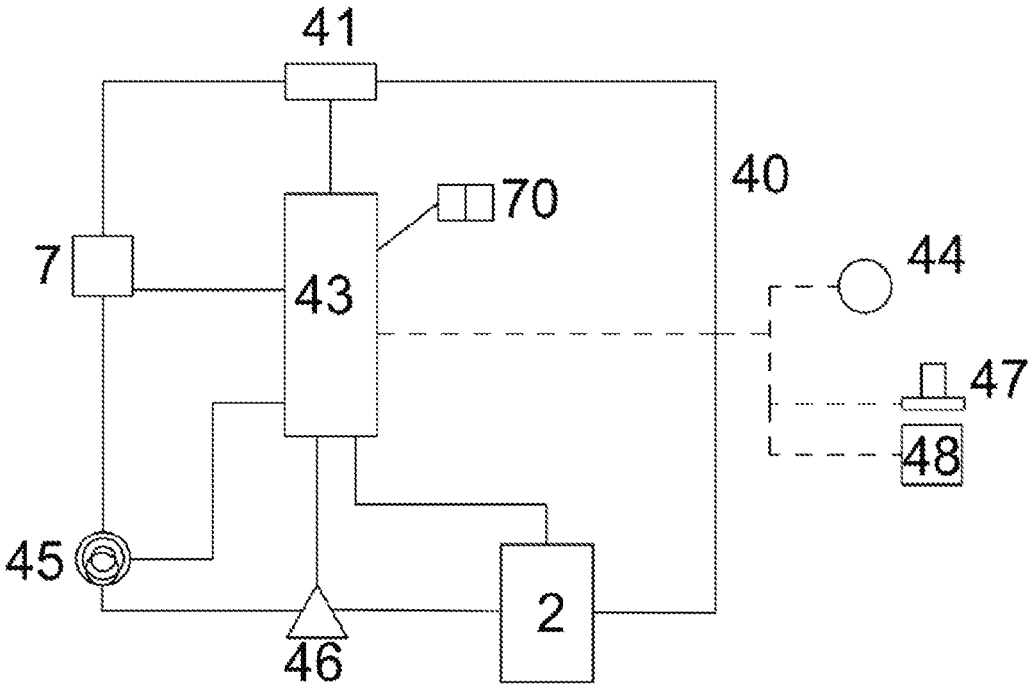
FIG. 5 Preferred plan of the IoT communication module according to the invention.

FIG. 5 represents a preferred example of an IoT communication module (40) according to the invention. This module comprises a physical communication interface with the user (2), a power source (41), a fourth electronic control means (43), a signal transceiver (45) and notification means (46) and communicates with at least one of the following elements: a) another module of the water control system (1), b) a sensor external to the module (44), c) an actuator external to the module (47) and/or d) a control device external to the module (48).

Figure 6:
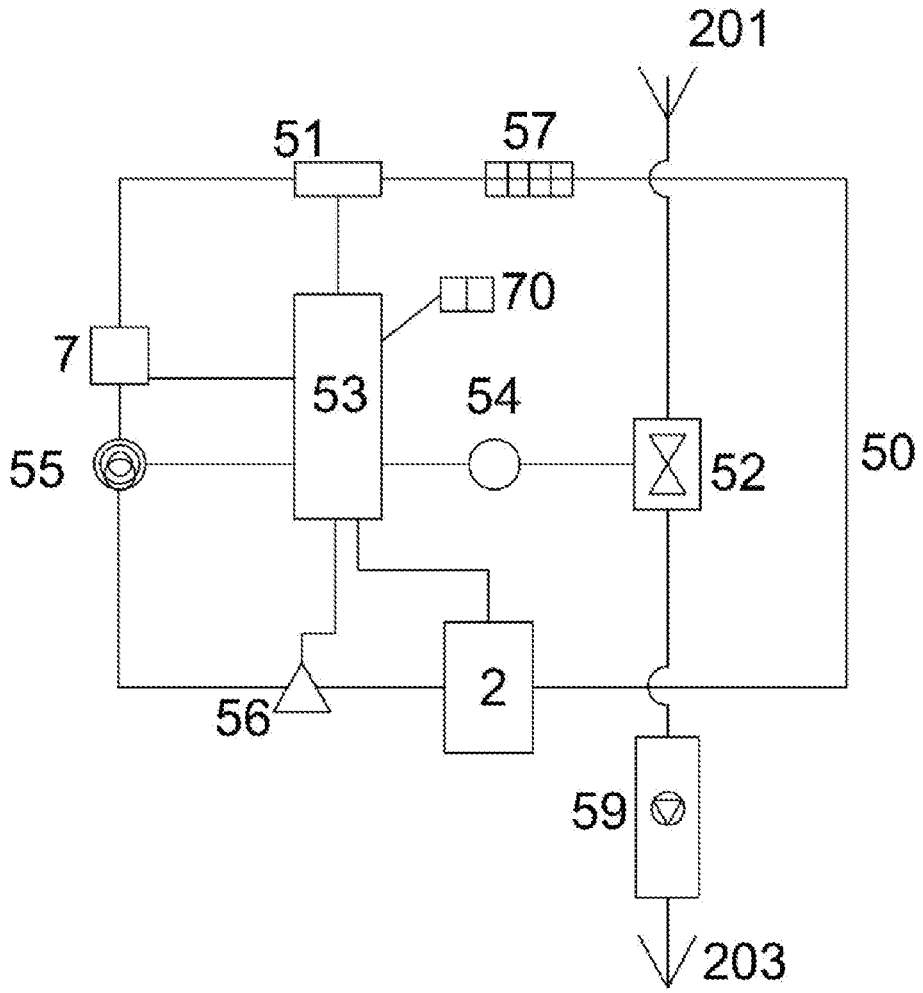
FIG. 6 Preferred plan of the control module according to the invention.

FIG. 6 represents a preferred example of a control and functional extension module (50) according to the invention. This module comprises a physical communication interface with the user (2), a power source (51), at least one valve (52) of at least 2-ways; on/off and/or gradual opening; electrovalve, manual valve or motorized valve; which in the completely open state allows the flow of water in its interior, a fifth electronic control means (53), at least one sensor (54), at least one signal transceiver (55), notification means (56) and a functional extension bay (57).

In FIGS. 2-6, the physical communication interface with the user (2) in each module (10, 20, 30, 40, 50) comprises at least one button and/or a display and/or a touch screen.

In FIGS. 2-6, the control means (13, 23, 33, 43, 53) of each module (10, 20, 30, 40, 50) are observed which manage the method of operation of the water control system (1) and include at least one of the following time variables management elements (70): a) a clock and/or b) a calendar and/or c) a timer. The control means (13, 23, 33, 43, 53) receive information by way of the signal transceivers (15, 25, 35, 45, 55) and store information: a) of the variables measured by at least one sensor (14, 24, 34, 44, 54) and/or obtained by way of actuators and external control devices (47, 48) and/or c) introduced by way of the physical communication interface with the user (2).

In FIGS. 2-6, the notification means (16, 26, 36, 46, 56) in each module (10, 20, 30, 40, 50) are observed which are at least one type from among sound, light and/or vibration notifiers to show signals concerning the operating state of the water control system (1).

In FIGS. 2-6, the power source (11, 21, 31, 41, 51) is at least one of the following: a) a power cable connected to the electricity network of the installation, b) a generator of electric energy by means of a system of turbines and/or solar cells and/or manual mechanism and/or thermoelectric or piezoelectric materials c) a battery rechargeable by its connection to a power cable or to an electric energy generator.

In FIGS. 2-6, the at least one sensor (14, 24, 34, 44, 54) of each module with sensor (10, 20, 30, 40, 50) comprises at least one sensor of: a) the temperature of the fluid, or b) pressure, or c) flow rate, or d) temperature of the environment, or e) humidity of the environment or f) chemical properties of the water or g) level of a reservoir or cistern, or h) presence and/or distance, or i) a biometric property; where the biometric sensor comprises at least one of the following elements: voice recognition by means of a microphone, image recognition by means of a camera or fingerprint recognition by means of a fingerprint sensor.

In one particular embodiment, the joining module (20) and/or the control module (50) comprises a repository (28, 58) accessible to the user for introducing liquid and/or solid substances which are mixed with the flow of water during operation. This repository (28, 58) is controlled by at least one valve (22, 52) such that: in a first position, it puts said repository (28, 58) in contact with the at least one pipe of the installation (200, 300) through which the water circulates through the joining (20) and/or control module (50), creating a fluid with properties modified by the substances in effect from where the at least one joining (20) and/or control module (50) is installed to a determined consumption point (205) when the fluid is moving and prevents the opening of the repository (28, 58) for the dosing of substances; and in a second position, said valve (22, 52) allows the dosing of substances modifying the properties of the water to the repository (28, 58) while said repository (28, 58) is not connected to the flow of water of the at least one pipe which passes through the joining (20) and/or control module (50), ensuring in any case that the flow of water passing through the affected module (20, 50) does not leave through the repository (28, 58) when it is being operated by the user.

In one particular embodiment, the control module (50) also comprises a secondary pumping system (59).

In one particular embodiment, the control module (50) is integrated as part of an external control or water flow monitoring system and/or a water treatment system in at least one of the following options: a) a counter, b) a flow rate and/or pressure regulating system, c) an anti-lime system, d) a filtering system or e) a purification system of water for consumption.

In one particular embodiment, at least one module (10, 20, 30, 40, 50) of the water control system (1) includes a visualization means (7) of the information available in the control means (13, 23, 33, 43, 53).

The water control system (1) is characterized in that there are activation/stop conditions (14, 24, 34, 44, 54, 47, 70, 2, 48) which are interpreted by the third control means (34) for the initiation of the method of operation of the water control system (1) and which are interpreted by the control means (13, 23, 33, 43, 53) of any module (10, 20, 30, 40, 50) for the finalization of the method of operation of the water control system (1) and where said activation and/or stop conditions (14, 24, 34, 44, 54, 47, 70, 2, 48) are generated by:

a) a user of the water control system (1) by means of the actuation of: i) an external control device (48), ii) an element of the physical communication interface with the user (2), iii) at least one sensor (14, 24, 34, 44, 54) and/or an external actuator (47);

b) the water control system (1), without intervention by the user and automatically, as a response to i) a pre-programmed time routine in at least one control means (13, 23, 33, 43, 53) according to at least one variable controlled by at least one time variable management element (70), ii) the information received by at least one sensor (14, 24, 34, 44, 54).

and where the activation and/or stop conditions (14, 24, 34, 44, 54, 47, 70, 2, 48) are received in the third control means (33) directly and/or by way of the signal transceiver (35).

In one particular embodiment, the activation and/or stop conditions (14, 24, 34, 44, 54, 47, 70, 2, 48) of the water control system (1) include measuring the complete dilution of a substance modifying the properties of the flow in the water by means of a sensor (14, 24, 34, 44, 54) of the chemical properties of the water.

Figure 7:
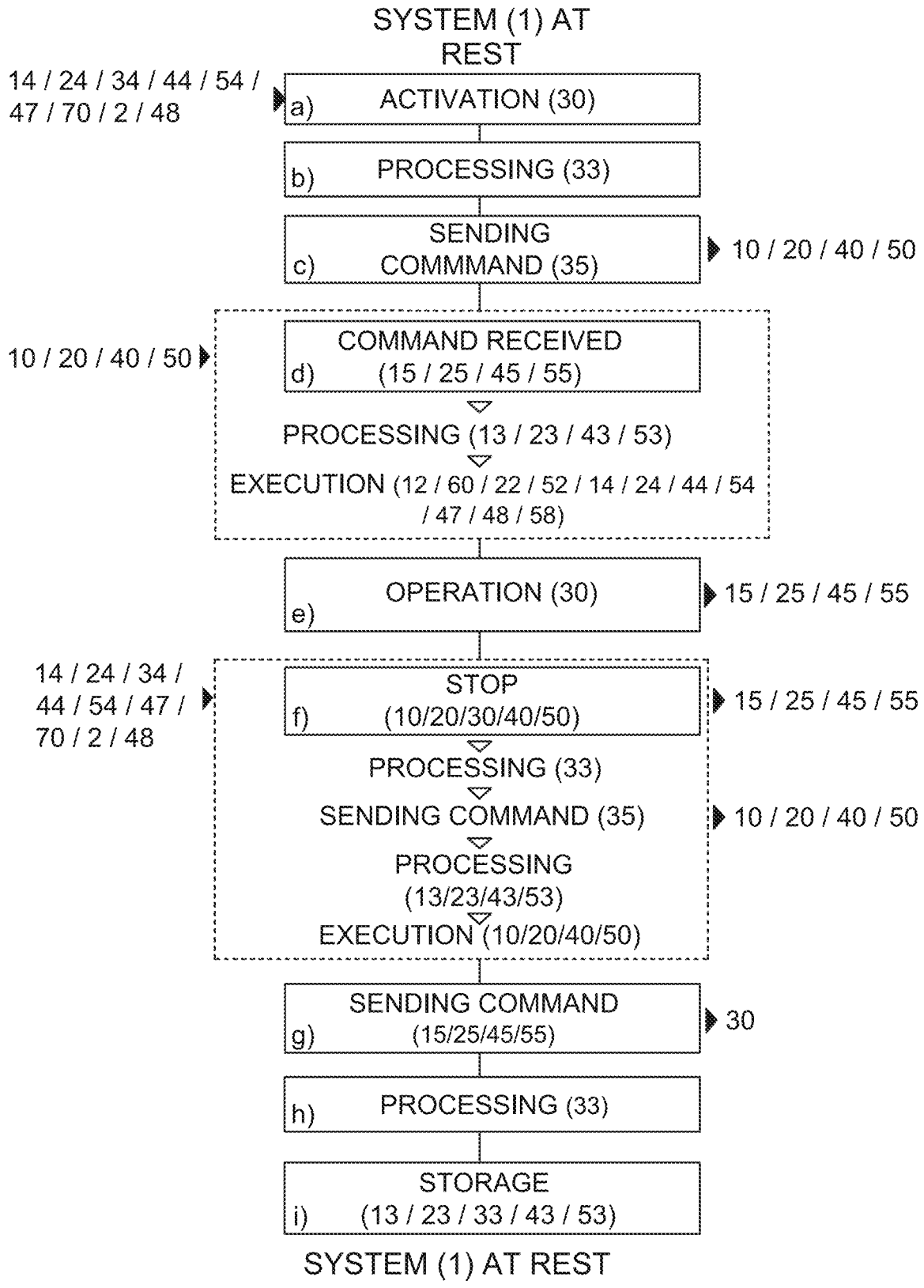
FIG. 7 Diagram of the steps of the method of operation of the water control system.

FIG. 7 represents a block diagram with basic operation for each one of the functions of the system, with objectives and courses different to the water depending on the location of the modules (10, 20, 30, 40, 50) in the installation (200, 300), the number and type of modules used in each method of operation (10, 20, 30, 40, 50) and the activation and/or stop conditions (14, 24, 34, 44, 54, 47, 70, 2, 48). The method of operation of the water control system (1) consists of the following steps:

a) proceeding from a water control system (1) whose modules (10, 20, 30, 40, 50) are in the rest state, the third control module (33) receives an activation and/or stop condition (14, 24, 34, 44, 54, 47, 70, 2, 48), generated by a user or by the water control system (1) itself automatically; which means that the change of state of the water control system (1) from rest to operating, b) the third control means (33) processes the received condition, determining the action to be executed in each module (10, 20, 30, 40, 50), c) the initiator module (30) executes the action determined by its control means (33) and sends, by means of the signal transceiver (35), a signal to each module (10, 20, 40, 50) with information on the action which each module (10, 20, 40, 50) should execute and, in parallel, sends signals to initiate the method of operation by way of the notification means (36), d) each module of the system (10, 20, 40, 50) receives the original signal from the initiator module (30) by way of its signal transceiver (15, 25, 45, 55), being processed by its control means (13, 23, 43, 53), and executed by the at least one controlled element of: a pumping system (12, 59), a valve (22, 52), a sensor (14, 24, 44, 54), an external actuator (47), an external control device (48), or the element coupled in the functional extension bay (57), e) by way of the notification means (16, 26, 46, 56), the at least one module (10, 20, 40, 50) reflects the receipt of the information and the initiation of the method of operation, and sends a return signal to the initiator module (30) by way of the signal transceiver (15, 25, 45, 55) so that it recognizes the initiation of the operation, which is maintained, by way of the controlled elements (12, 35 60, 22, 52, 14, 24, 44, 54, 47, 48, 58), until at least one new activation and/or stop condition (14, 24, 34, 44, 54, 47, 70, 2, 48) is detected which returns the modules (10, 20, 40, 50) to the rest condition, f) when an activation and/or stop condition (14, 24, 34, 44, 54, 47, 70, 2, 48) is identified in at least one control means (13, 23, 33, 43, 53), said control means interrupts the operation of its controlled element (12, 60, 22, 52, 14, 24, 44, 54, 47, 48, 58), sending a signal to the rest of the modules (10, 20, 40, 50) by way of the signal transceiver (15, 25, 35, 45, 55), and sending signals of the finalization of the method of operation by way of the notification means (16, 26, 36, 46, 56), g) the detection signal of an activation and/or stop condition (14, 24, 34, 44, 54, 47, 70, 2, 48) is received by the rest of the modules (10, 20, 40, 50) which interrupt the operation of its controlled elements (12, 60, 22, 52, 14, 24, 44, 54, 47, 48, 58), sending signals of the finalization of the method of operation by way of the notification means (16, 26, 36, 46, 56), and sending a signal with information indicating the availability of the water control system (1) for an operation restart to the third control means (33) by means of the signal transceiver (15, 25, 35, 45, 55), h) the information of the executed method of operation is stored in a database (400) of at least one control means (13, 23, 33, 43, 53), the modules (10, 20, 30, 40, 50) remaining in their original rest state awaiting the new activation and/or stop condition (14, 24, 34, 44, 54, 47, 70, 2, 48).

In one particular embodiment, the method of operation of a water control system (1) is characterized in that prior to step a), the method comprises at least one of the following phases: i) a prior identification process by means of at least one biometric sensor and/or an element of the physical communication interface with the user (2) and/or ii) the dosing of a substance by the user in one of the repositories (28, 58) of the joining (20) and/or control module (50), respectively or in the functional extension bay (57) of the control module (50).

Figure 8:
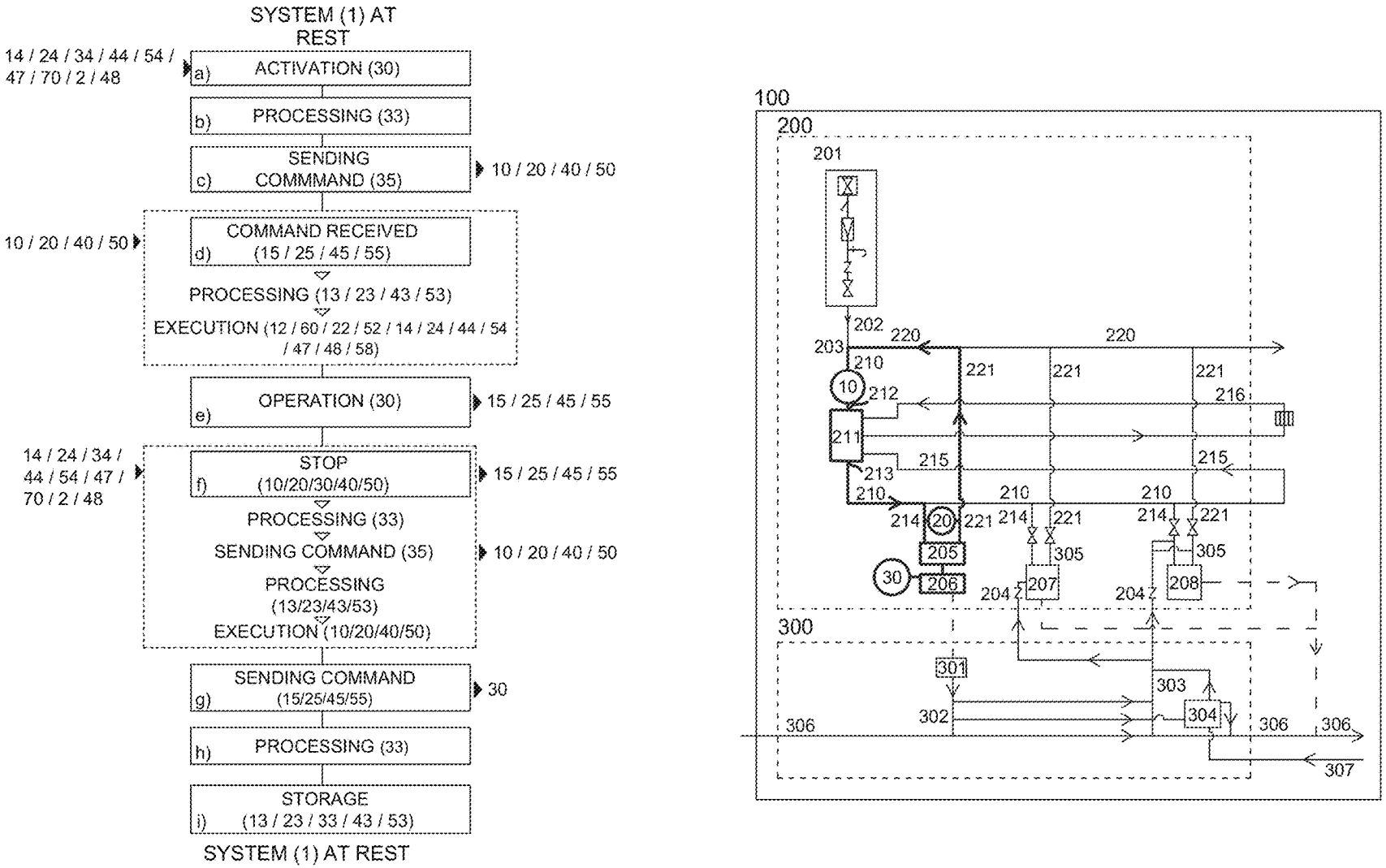
FIG. 8 Preferred example of the water supply installation provided with a water control system and a diagram of the method of operation according to a particular embodiment of the invention whose result is the preheating of water in the hot water branch prior to consumption.

FIG. 8 represents a preferred example of the water supply installation (200) provided with a water control system (1) and a diagram of the method of operation according to one particular embodiment of the invention, whose result is the preheating of the water in the hot water branch (210) prior to consumption by means of recirculation, using at least one initiator module (30), situated in proximity to a consumption point (205) and at least one power module (10), situated in the hot water branch (210) before the cold water inlet to the heater (212) and at least one joining module (20), situated joining at least one hot water pipe (214) to at least one cold water pipe (221); the closer the position of the joining module (20) to the last consumption point (205) of the installation (200), the greater coverage the preheating effect will have.

Given activation and/or stop conditions (14, 24, 34, 44, 54, 47, 70, 2, 48) in the initiator module (30), the joining module (20) changes the state of at least one valve (22) from closed to open, and the affected power module (10) initiates the movement of its pumping system (12), causing the recirculation of water through the heater (211) from the affected power module (10) to the at least one affected joining module (20), in a closed circuit, maintaining the operation until at least one new activation and/or stop condition (14, 24, 34, 44, 54, 47, 70, 2, 48) is detected from: a) detection by way of at least one sensor (14, 24) in at least one power (10) and/or joining module (20) of a temperature and/or pressure of the water and/or determined operating time or b) the activation in any of the modules (10, 20, 30) of an external stop means in the physical interface with the user (2); after which the power module (10) stops the movement of the pumping system (12) and the at least one valve (22) of the at least one joining module (20) changes its state from open to closed again.

Figure 9:
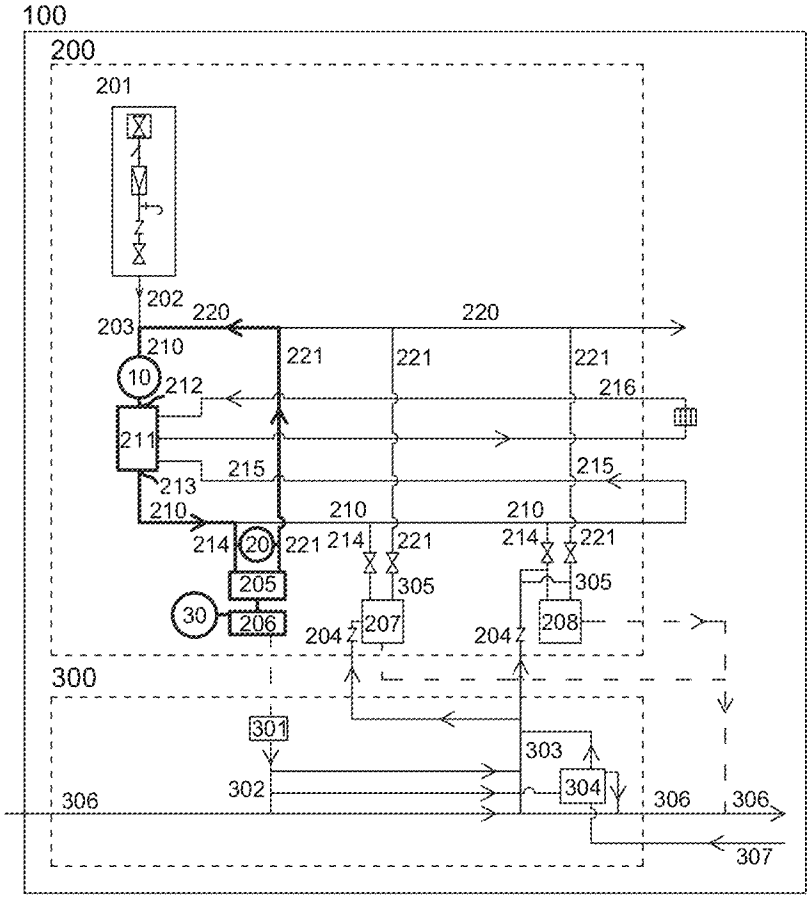
FIG. 9 Preferred example of the water supply installation provided with a water control system and a diagram of the method of operation according to a particular embodiment of the invention whose result is the prevention of damage from freezing.
Figure 9:
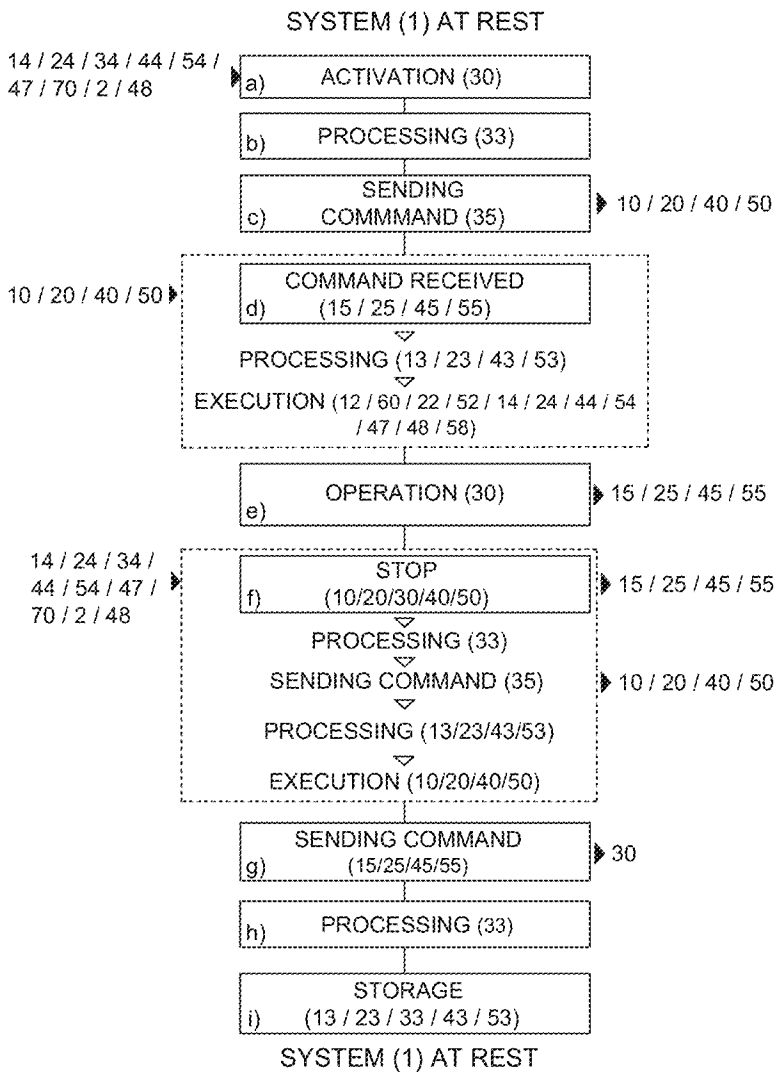

FIG. 9 represents a preferred example of the water supply installation (200) provided with a water control system (1) and a diagram of the method of operation according to one particular embodiment of the invention, whose result is the prevention of damage due to freezing, using at least one initiator module (30), situated at any point and at least one power module (10) situated in the hot water branch (21) before the cold water inlet to the heater (212) and at least one joining module (20) situated joining at least one hot water pipe (214) to at least one cold water pipe (221); the further away its position to the heater (211), the greater coverage the effect will have of preventing damage due to freezing.

At least one activation and/or stop condition (14, 24, 34, 44, 54, 47, 70, 2, 48) of at least one initiator module (30) is automatically generated and involves the measurement of at least one sensor (14, 24) of at least one power module (10) and/or at least one joining module (20) of a temperature of the water equal to or less than a value established in a control means (13, 23) of the modules (10, 20) such that the joining module (20) changes the state of at least one valve (22) from closed to open and the power module (10) initiates the movement of its pumping system (12), involving the recirculation of water through the heater (211) from the power module (10) to the at least one joining module (20), in a closed circuit, maintaining the operation until at least one new activation and/or stop condition (14, 24, 34, 44, 54, 47, 70, 2, 48) is detected: from: a) the detection by way of at least one sensor (14, 24) in at least one power (10) and/or joining module (20) of a temperature and/or pressure of the water and/or determined operating time or b) the activation in any of the modules (10, 20, 30) of an external stop means in the physical interface with the user (2); at which the power module (10) stops the movement of the pumping system (12) and the at least one valve (22) of at least one affected joining module (20) changes its state from open to closed again.

Figure 10:
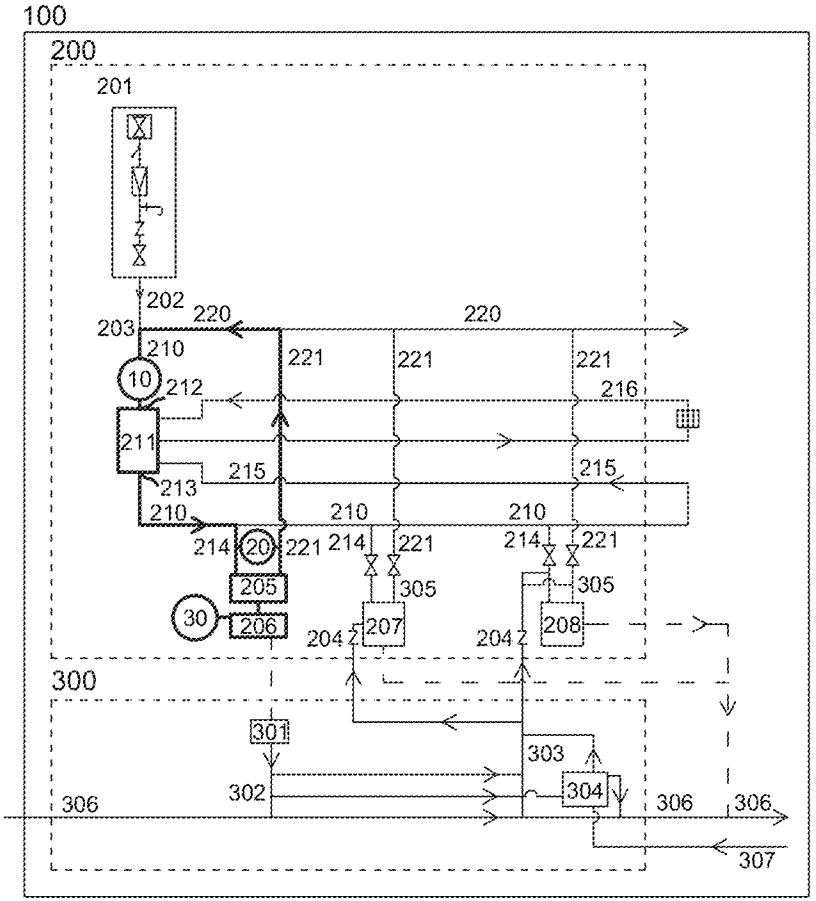
FIG. 10 Preferred example of the water supply installation provided with a water control system and a diagram of the method of operation according to a particular embodiment of the invention whose result is the analysis and prevention of the proliferation of bacteria.
Figure 10:
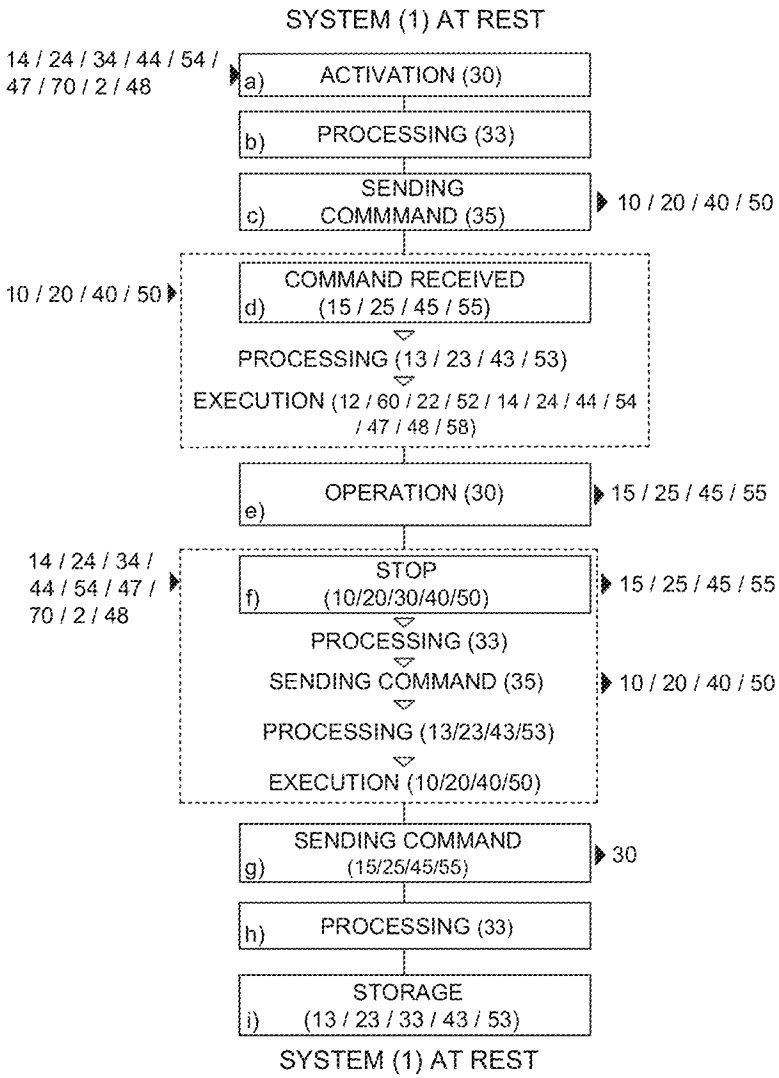

FIG. 10 represents a preferred example of the water supply installation (200) provided with a water control system (1) and a diagram of the method of operation according to one particular embodiment of the invention whose result is the analysis and prevention of the proliferation of bacteria, using at least one initiator module (30), situated at any point and at least one power module (10) situated in the hot water branch (210) before the cold water inlet to the heater (212) and at least one joining module (20) situated joining at least one hot water pipe (214) to at least one cold water pipe (221).

At least one activation and/or stop condition (14, 24, 34, 44, 54, 47, 70, 2, 48) of at least one initiator module (30) is generated automatically by means of at least one time variable management element (70) from a clock and/or a calendar such that the joining module (20) changes the state of at least one valve (22) from closed to open and the power module (10) initiates the movement of its pumping system (12), involving the recirculation of water through the heater (211) from the power module (10) to the at least one joining module (20), in a closed circuit, maintaining the operation until at least one new activation and/or stop condition (14, 24, 34, 44, 54, 47, 70, 2, 48) is detected: from: a) the detection by way of at least one sensor (24) of a joining module (20) of a temperature of the water upon arrival to at least one consumption point (205) and/or a determined operating time used in the process by means of at least one time variable element (70) from: a clock and/or a timer in at least one of the modules (10, 20, 30) or b) the activation in any of the modules (10, 20, 30) of an external stop means in the physical interface with the user (2); at which time the power module (10) stops the movement of the pumping system (12) and the at least one valve (22) of the at least one affected joining module (20) changes its state from open to closed again.

In one particular embodiment, the method of operation of the water control system (1), whose result is the analysis and prevention of the proliferation of bacteria includes the intervention of at least one control module (50) situated in the branching (203) between cold (220) and hot (210) water branches and where said control module (50) injects biocidal substances from its repository (58) to the flow of water of the supply installation (200) during operation of the water control system (1).

Figure 11:
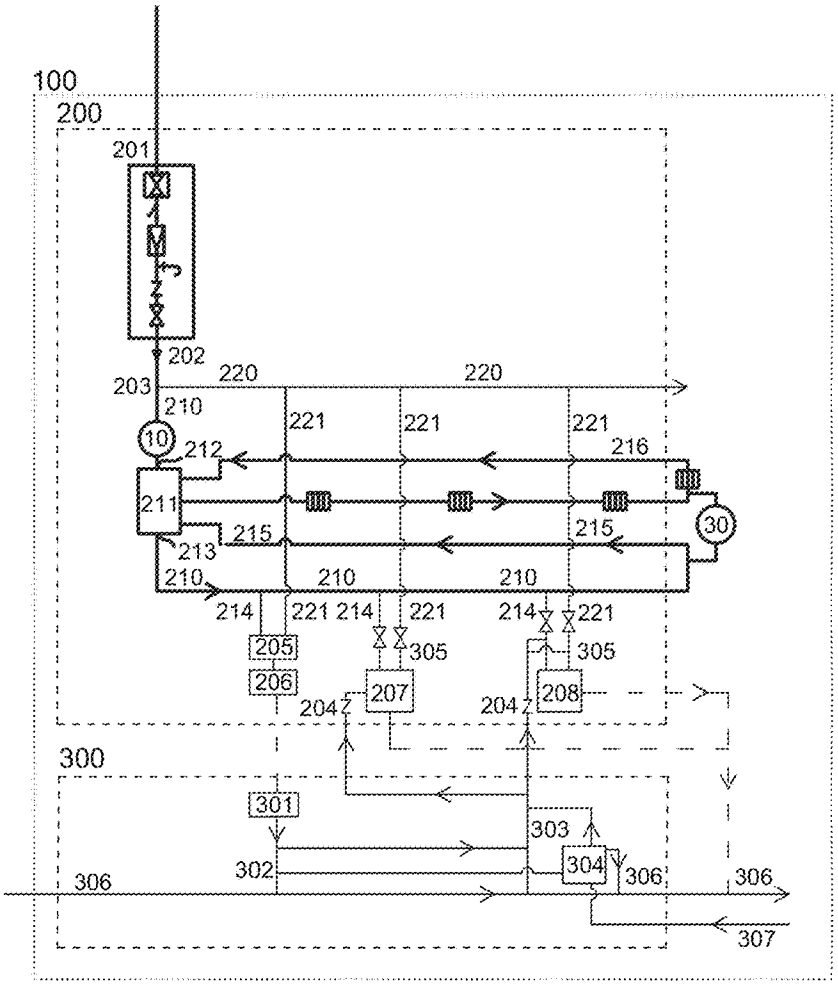
FIG. 11 Preferred example of the water supply installation provided with a water control system and a diagram of the method of operation according to a particular embodiment of the invention whose result is the management of heating and/or recirculation networks.
Figure 11:
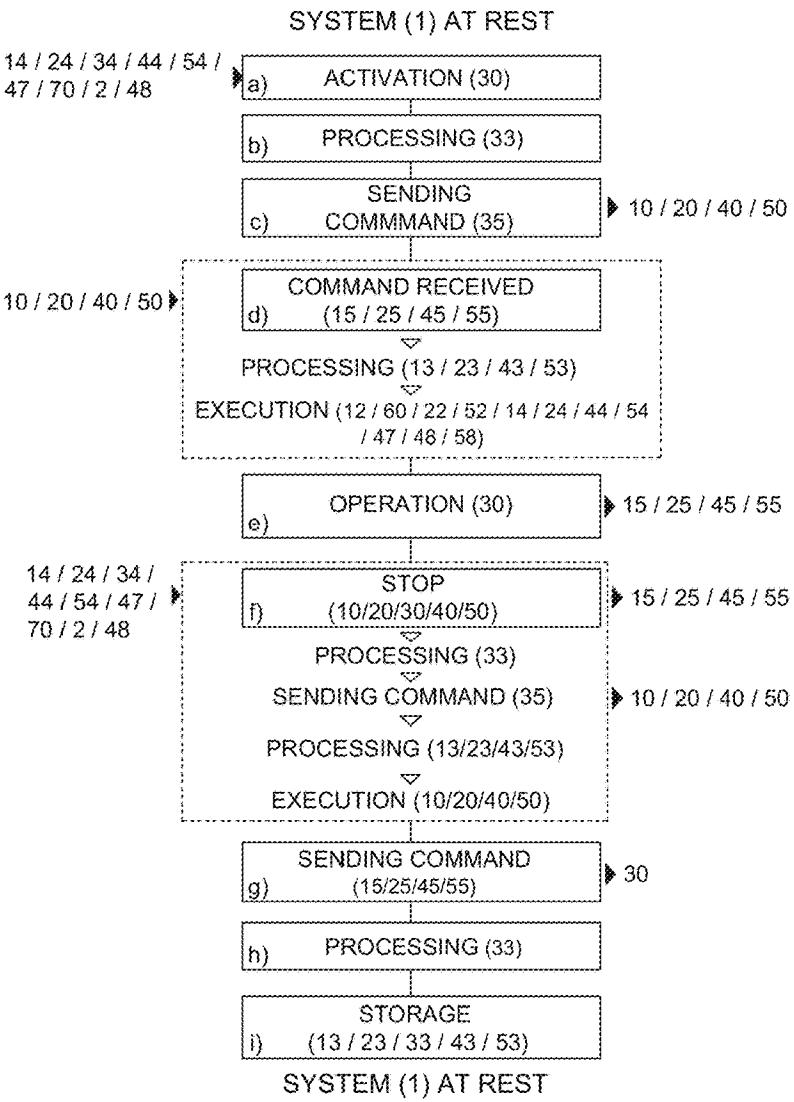

FIG. 11 represents a preferred example of the water supply installation (200) provided with a water control system (1) and a diagram of the method of operation according to one particular embodiment of the invention, whose result is the management of heating and/or recirculation networks, using at least one initiator module (30), situated at any point and at least one power module (10) situated in the hot water branch (210) before the cold water inlet to the heater (212).

At least one activation and/or stop condition (14, 24, 34, 44, 54, 47, 70, 2, 48) of at least one initiator module (30) is generated automatically by means of at least one sensor (14) of at least one power module (10), installed in a hot water branch (210) of a temperature of the water equal to or less than a value established in a control means (13, 33) of the power (10) and/or initiator (30) modules and/or by means of at least one time variable management element (70) from a clock and/or a calendar such that the power module (10) initiates the movement of its pumping system (12), involving the recirculation of water through the heater (211) from the power module (10) and throughout the installation in a closed circuit, maintaining the operation until at least one new activation and/or stop condition (14, 24, 34, 44, 54, 47, 70, 2, 48) is detected: from: a) the detection in at least one sensor (14) of a power module (10) of a temperature of the water and/or an environmental temperature and/or a determined operating time used in the process by means of at least one time variable element (70) from: a clock and/or a timer in at least one of the modules (10, 30) or b) the activation in any of the modules (10, 30) of an external stop means in the physical interface of the user (2); at which time the power module (10) stops the movement of the pumping system (12).

Figure 12:
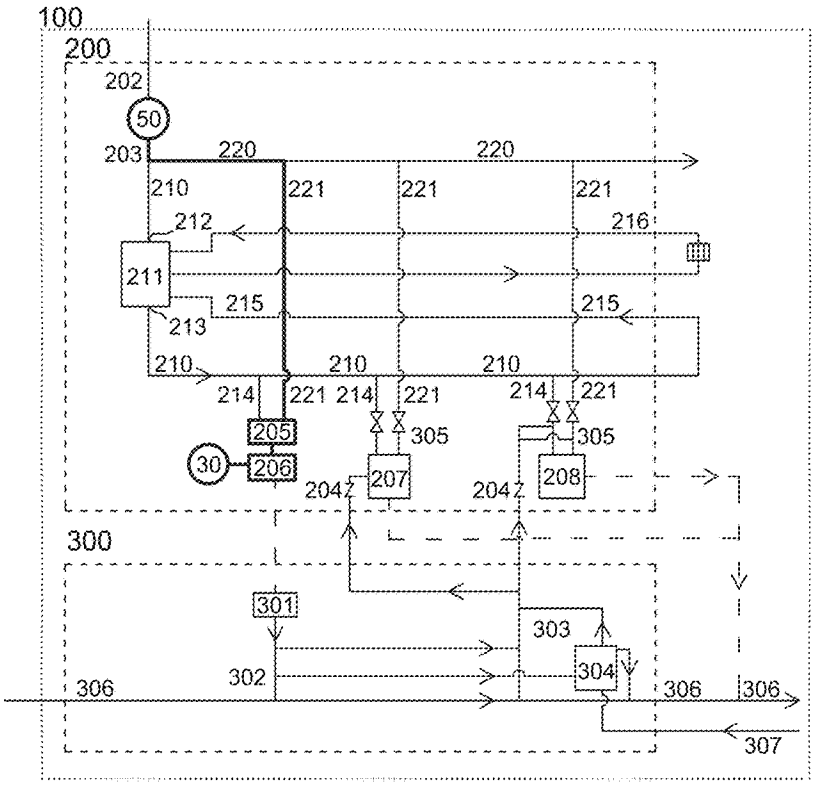
FIG. 12 Preferred example of the water supply installation provided with a water control system and a diagram of the method of operation according to a particular embodiment of the invention whose result is the modification of the properties of the consumption fluid and/or maintenance of the water supply installation.
Figure 12:
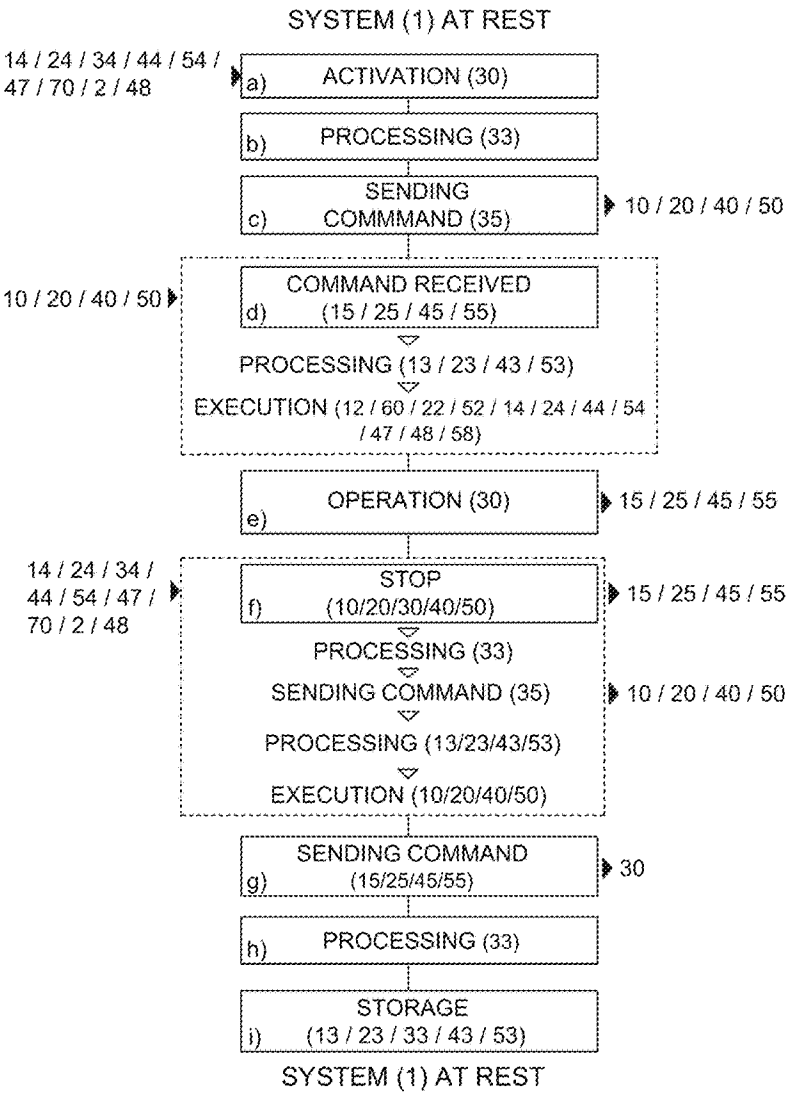

FIG. 12 represents a preferred example of the water supply installation (200) provided with a water control system (1) and a diagram of the method of operation according to one particular embodiment of the invention whose result is the modification of the properties of the fluid for consumption and/or maintenance of the installation (200), characterized in that it uses an initiator module (30) for the initiation of the operation and in that in a phase prior to the operation, the user introduces a determined substance in:

a) at least one control module (50), by way of the repository (58), the control module being located: in the supply connection (201) or in the general water supply pipe (202) or in the branching (203) between hot water branch (210) and cold water branch (220).

b) at least one joining module (20) where at least one joining module (20) is in accordance with one particular embodiment and comprises a repository (28) where a determined substance is introduced, the joining module (20) being located at a consumption point of the cold water branch (220) or hot water branch (210).

When at least one activation and/or stop condition (14, 24, 34, 44, 54, 47, 70, 2, 48) of at least one initiator module (30) is detected, the joining (20) and/or control module (50) put the substance of the repository (28, 58) in contact with the flow of water, by means of the use of at least one valve (22, 52) when the flow of water is activated at a consumption point (205), maintaining the operation until at least one new activation and/or stop condition (14, 24, 34, 44, 54, 47, 70, 2, 48) is detected or the user advises that the effect of the substance introduced into the flow of water has ended, returning the at least one actuated valve (22, 52) to its original position, interrupting the fluid communication between the repository (28, 58) and the consumption flow.

In one particular embodiment, the effect of a substance introduced into at least one module (20, 50) with repository (28, 58) is reproduced by an external device for water treatment connected to the water control system (1) by way of the functional extension bay (57).

Figure 13:
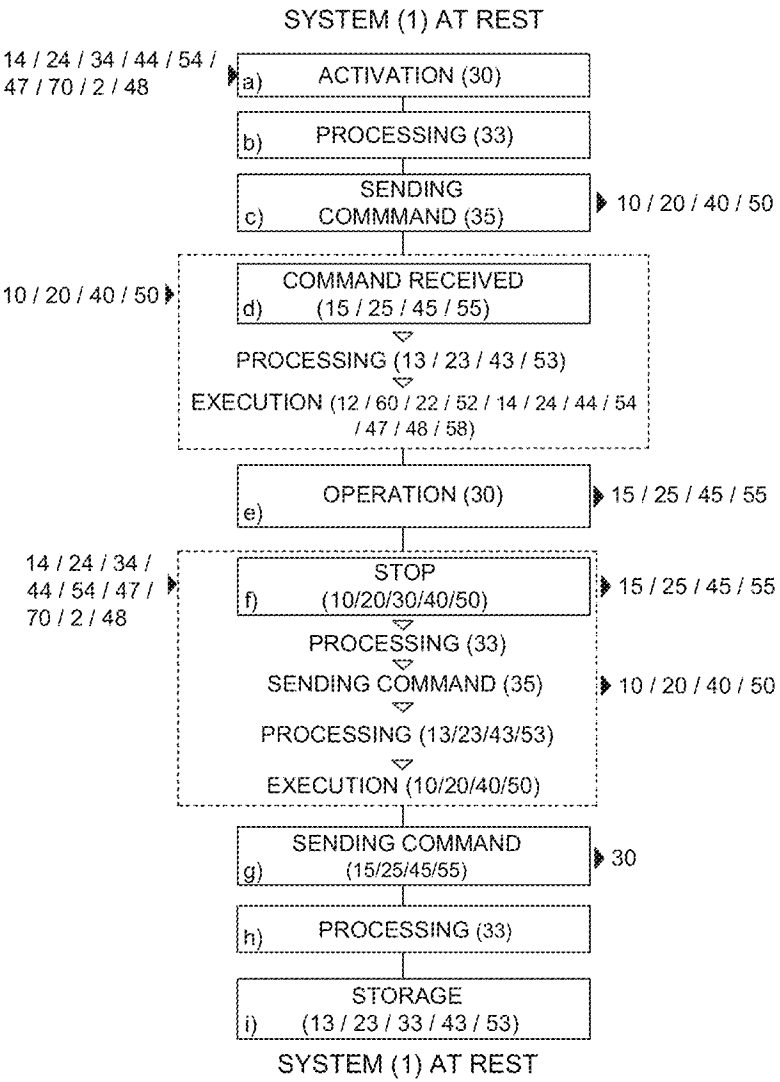
FIG. 13 Preferred example of the water supply installation provided with a water control system and a diagram of the method of operation according to a particular embodiment of the invention whose result is the modification of the properties of the working fluid and maintenance of the water supply installation.

FIG. 13 represents a preferred example of the water supply installation (200) provided with a water control system (1) and a diagram of the method of operation according to one particular embodiment of the invention whose result is the modification of the properties of the working flow and maintenance of the water supply installation (200), using at least one initiator module (30) situated at any point, at least one power module (10) situated in the hot water branch (210) before the cold water inlet to the heater (212) and at least one joining module (20) which according to one particular embodiment has a repository (28) which puts a substance dosed by the user into said repository (28) in fluid communication with the flow of water passing through the module (20) due to the action of a valve (22), the joining module (20) being situated: a) connecting at least two points of a hot water installation (210) and/or b) connecting at least one point of a hot water installation (210) with at least one point of a cold water installation (220).

In a phase prior to operation, the user introduces a determined substance into the repository (28) of the joining module (20) and given at least one activation and/or stop condition (14, 24, 34, 44, 54, 47, 70, 2, 48) in the initiator module (30), the joining module (20) changes the state of at least one valve (22) from closed to open and the power module (10) initiates the operation of its pumping system (12) moving the water with properties modified by means of the substance dosed into the repository (28) of the joining module (20), in closed circuit through the installation (100), maintaining the operation until at least one new activation and/or stop condition (14, 24, 34, 44, 54, 47, 70, 2, 48) is detected, returning the at least one actuated valve (22) to its original position, interrupting the fluid communication between the repository (28) and the consumption flow and stopping the pumping system (12) of the power module (10).

Figure 14:
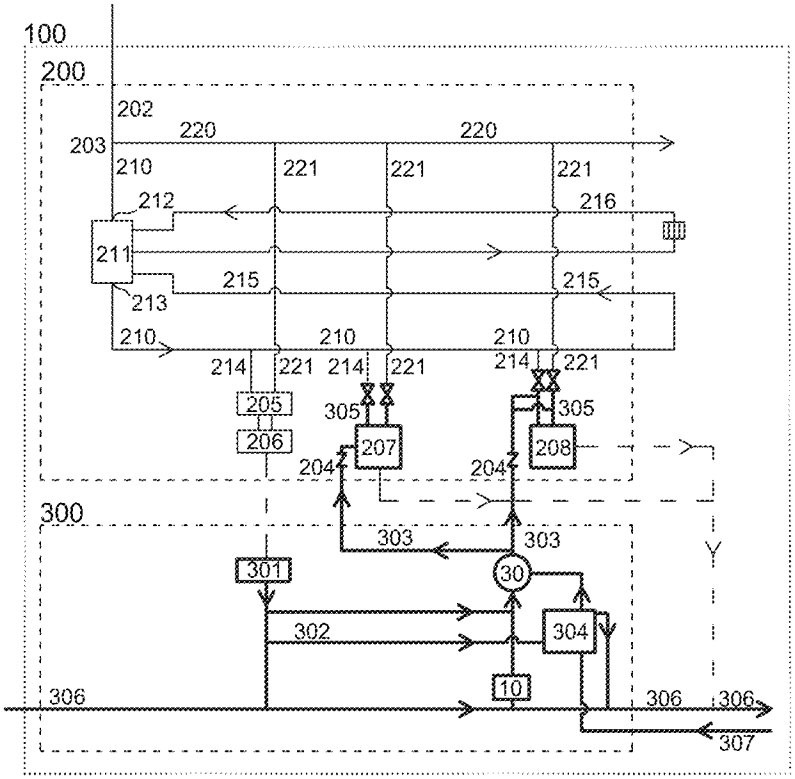
FIG. 14 Preferred example of gray water collection installation provided with a water control system and a diagram of the method of operation according to a particular embodiment of the invention whose result is the utilization of gray water in a gray water collection installation.
Figure 14:
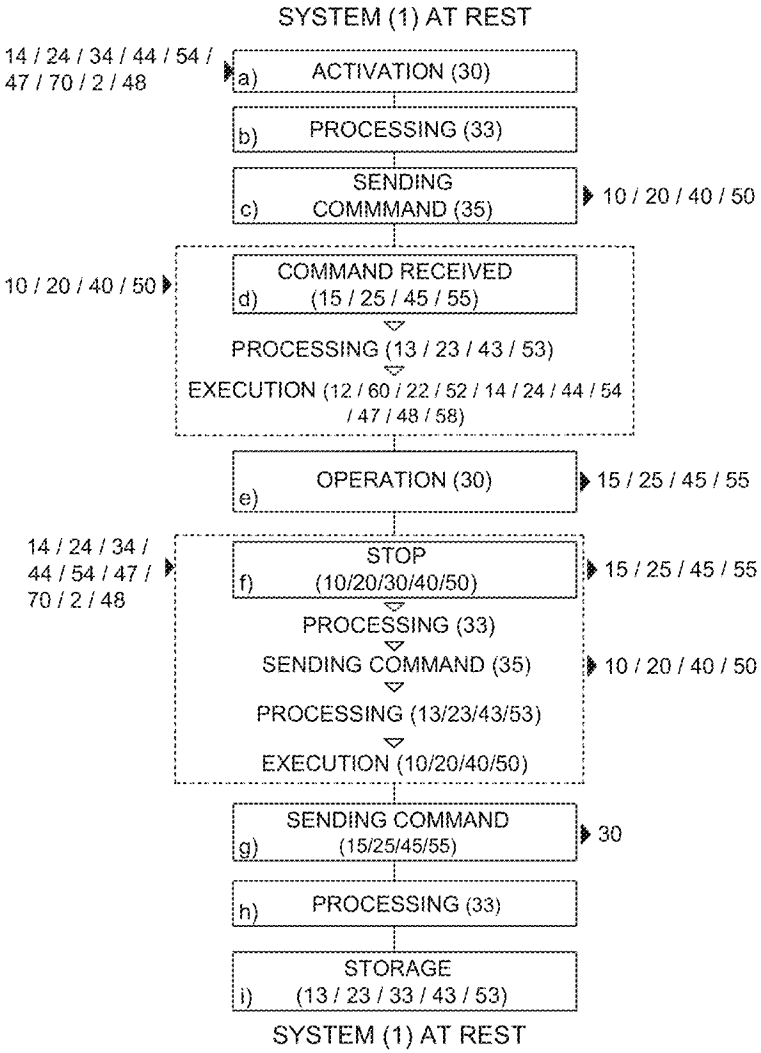

FIG. 14 represents a preferred example of the gray water collection installation (300) provided with a water control system (1) and a diagram of the method of operation according to one particular embodiment of the invention whose result is the utilization of gray water in a gray water collection installation (300), using at least one initiator module (30) situated at any point or close to the consumption point (205) where it is intended to utilize the gray water, at least one power module (10) situated at one point of the gray water collection installation (300) in:

a) the additional gray water utilization pipe (303) and which connects to: a) the cistern (207) or flushometer (208) of the sanitation device which discharges the gray water or b) a connection point (305) of the water supply installation (200) which in turn connects to the cistern (207) or flushometer (208) of the sanitation device which discharges the gray water or b) connected to the gray water utilization reservoir (304).

In one particular embodiment, the power module suctions water arriving to the gray water utilization pipe (303) by the effect of gravity when the water is discharged through the drain (301), pumping it towards the sanitation device directly or indirectly, in the first case, connecting said gray water utilization pipe (303) directly to the discharge cistern (207) or flushometer (208) and, in the second case, connecting said gray water utilization pipe (303) to a hot (214) and/or cold (221) water pipe which discharges towards the cistern (207) or flushometer (208) of the sanitation device.

Given at least one activation and/or stop condition (14, 24, 34, 44, 54, 47, 70, 2, 48) in the initiator module (30), the power module (10) activates the pumping system (12) such that the gray water discharged through at least one drain (301) towards the gray water pipe (302) and from there towards the gray water utilization pipe (303) and/or towards the gray water reservoir (304) are pumped by the power module (10), circulating through the additional gray water utilization pipe (303) for its use in another sanitation device, maintaining the operation until at least one new activation and/or stop condition (14, 24, 34, 44, 54, 47, 70, 2, 48) is detected from: a) the measurement of at least one sensor (14) of flow rate and/or pressure in the power module (10) and whose value is contrasted with at least one control means (13, 33) under whose criterion, including the measurement of time variables (70), the operation concludes, interrupting the movement of the pumping system (12) of the power module (10).

In one particular embodiment, there is a joining module (20) installed in at least any of the locations possible for the power module (10) and which, by means of the opening/closing of its at least one valve (22), allows or interrupts the passage of water towards the gray water utilization pipe (303).

Figure 15:
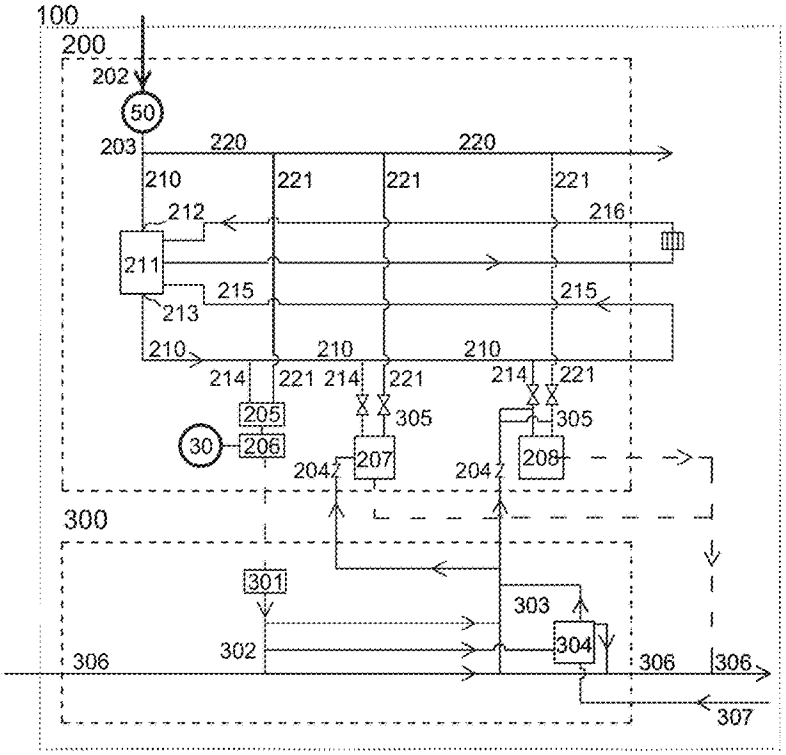
FIG. 15 Preferred example of the water supply installation (200) provided with a water control system (1) and a diagram of the method of operation according to a particular embodiment of the invention whose result is the notification and blocking of undesired consumption of water.
Figure 15:
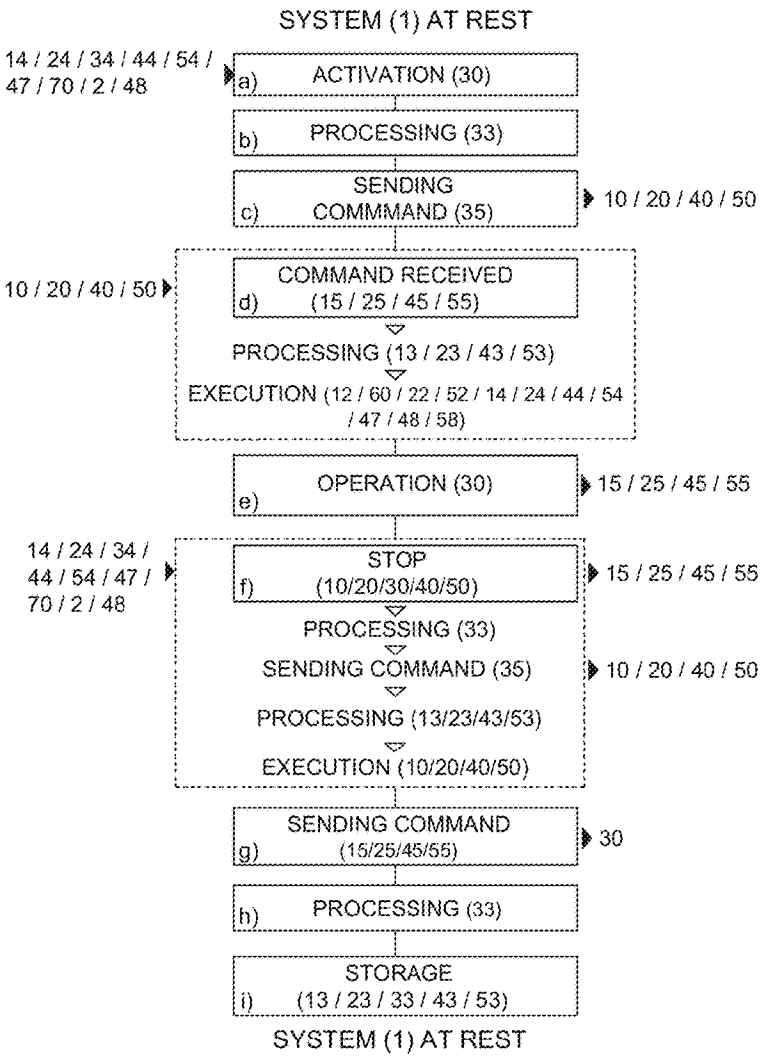

FIG. 15 represents a preferred example of the water supply installation (200) provided with a water control system (1) and a diagram of the method of operation according to one particular embodiment of the invention whose result is the notification and blocking of undesired water consumption, using at least one initiator module (30) installed at any point of the installation preferably close to the inlet to the same, at least one IoT communication module (40) situated at any point and at least one control module (50) preferably installed in the supply connection (201) of the water supply installation (200).

Given at least one activation and/or stop condition (14, 24, 34, 44, 54, 47, 70, 2, 48) of at least one initiator module (30), the control module (50) detects, by way of at least one flow rate and/or pressure sensor (54) if there is a flow of water which, with respect to the information contained in at least one control means (33, 43, 53), is considered undesirable; a situation in which the water control system (1) executes at least one of the following actions:

a) shows a clear notification signal of this condition by way of the available notification means (36, 46, 56), b) sends, by way of the signal transceiver (35, 45, 55), information of this condition to an external control device (48), such that due to the interaction of the user directly by way of the physical communication interface with the user (2) or indirectly by way of the external control device (48) and/or automatically according to the flow rate and time (70) variables processed by at least one control means (33, 43, 53), the control module (50) changes the state of at least one valve (52) from open to closed, preventing the passage of water through this valve (52) towards the interior of the water supply installation (200).

In one particular embodiment, the functions described use more modules (10, 20, 30, 40, 50) of the same type and of a different type to the minimum preferably used in the particular embodiments of the method of operation, extending the coverage over which the method of operation has an effect and/or improving the control of the process by means of the operation of additional sensors and actuators in said modules (10, 20, 30, 40, 50) and its activation and/or stop conditions (14, 24, 34, 44, 54, 47, 70, 2, 48).

What is claimed is:

1. A water control system adapted for being installed in a plumbing installation which includes a water supply installation and a gray water collection installation, the water supply installation comprising a supply connection, a general pipe, a branching point in which the general pipe is branched towards a hot water branch and a cold water branch, a non-return valve, situated upstream of the branching point, a water heater, with at least one inlet and at least one outlet, situated in the hot water branch, and at least one cold and/or hot water consumption point with at least one tap and to each one of which a cold pipe arrives coming from the cold water branch and/or a hot water pipe coming from the hot water branch and the gray water collection installation comprising a drain through which the water from a consumption point arrives, a gray water pipe which connects downstream to a gray water utilization pipe, the control system comprising at least:

a power module which comprises a first power supply, a pumping system with variable flow rate, a first electronic controller, at least one first sensor, at least one first signal transceiver, first indicator for notifications, wherein the power module is installed in at least one point of the plumbing installation, a joining module which comprises a second power source, at least one first valve adapted for putting at least two pipes in fluid communication when said first valve is fully open, a second electronic controller, at least one second sensor, at least one second signal transceiver, second indicator for notifications, wherein the joining module is adapted to be situated in at least one point of the plumbing installation, an initiator module which comprises a third power source, activation elements, a third electronic controller, at least one third sensor, at least one third signal transceiver, third indicator for notifications, an IoT communication module which comprises a fourth power supply, a fourth electronic controller, a fourth signal transceiver and fourth indicator for notifications, wherein the IoT communication module is configured to communicate with at least one of the following elements:

a) another module of the water control system, and/or b) a sensor external to the IoT communication module and/or c) an actuator external to the IoT communication module and/or d) a control device external to the IoT communication module, a control and functional extension module which comprises a fifth power supply, at least one second valve adapted for allowing the flow of water in its interior when said second valve is fully open, a fifth electronic controller, at least one fourth sensor, at least one fifth signal transceiver, fifth indicator for notifications, a functional extension bay wherein the control and functional extension module is adapted for being installed at any point between the water supply connection of the water supply installation and the branching point including the supply connection itself and the branching itself, wherein each module comprises a physical communication interface; and wherein the electronic controller of each module has a memory where the information relating to the characteristics and the operation of the water control system is stored and which are configured for managing methods of operation of the water control system and for managing at least one time variable control element.

2. The water control system according to claim 1, wherein the power module is installed in the plumbing installation: a) in the hot water branch before the water inlet to the heater, or b) in the hot water branch integrated into the heater itself or c) in the hot water branch after the outlet of the water of the heater or d) in the cold water branch, or e) the gray water utilization pipe.

3. The water control system according to claim 1, wherein the joining module is installed in the plumbing installation: a) joining at least two points of the cold water branch, or b) joining at least two points of the hot water branch, or c) joining at least one point of the cold water branch to at least one point of the hot water branch or d) joining at least two points of the gray water collection installation or e) integrated in a tap.

4. The water control system according to claim 1, wherein at least one of the modules comprises a display of the information available in the memory of the water control system with respect to the characteristics and the operation of the water control system.

5. The water control system according to claim 1, wherein the power source is at least one of the following: a) a power cable connected to an electricity network, b) a generator of electric energy using a system of turbines and/or solar cells and/or manual mechanism and/or thermoelectric or piezoelectric materials, c) a rechargeable battery.

6. The water control system according to claim 1, wherein by way of the signal transceiver of each module, each electric controller receives and stores in respective memories information: a) on measurements made by the at least one sensor of respective modules and/or b) obtained by way of external actuators and control devices and/or c) introduced by way of the physical communication interface.

7. The water control system according to claim 1, wherein at least one of the sensors of respective modules of the water control system is at least one sensor of: a) temperature of the fluid, or b) pressure, or c) flow rate or d) temperature of the environment or e) humidity of the environment or f) chemical properties of the water or g) level of a reservoir or cistern or h) presence and/or distance or i) a biometric property.

8. The water control system according to claim 1, wherein the joining module and/or the control module comprises a repository for introducing liquid and/or solid substances which are mixed with the flow of water during operation, wherein said repository is controlled by at least one valve such that: in a first position, said valve puts said repository in contact with at least one of the pipes of the plumbing installation through which the water circulates through the joining and/or control module, creating a fluid with properties modified by the substance from where the at least one joining and/or control module is installed to a determined consumption point when the valve is open and preventing the opening of the repository for dosing of substances; and in a second position, said valve allows the dosing of substances modifying the properties of the water into the repository while said repository is not connected to the flow of water of the at least one pipe which passes through the joining and/or control module, ensuring using the valve that the flow of water passing through the affected module does not leave through the repository when it is being manually operated.

9. The water control system according to claim 1, wherein the control module also comprises a secondary pumping system.

10. The water control system according to claim 1, wherein there are activation and/or stop conditions which are interpreted a) by the third controller for the initiation of the method of operation of the water control system and b) by at least one of the electronic controllers of respective modules for the finalization of the method of operation of the water control system and where said activation and/or stop conditions are generated by:

a) an external element: i) an external control device, ii) an element of the physical communication interface, iii) an external actuator;

b) the water control system, as a response to i) a preprogrammed time routine controlled by at least one time variable management element, ii) the information received by at least one of the sensor of respective modules, wherein the activation and/or stop conditions are received in the third electric controller directly and/or by way of the third signal transceiver.

11. The water control system according to claim 10, wherein the activation and/or stop conditions include the measurement of the complete dilution of a substance modifying the properties of the flow in the water using a sensor of the chemical properties of the water.

12. The plumbing installation in the water control system according to claim 1, wherein the hot water branch of the water supply installation comprises at least one of the following:

a) at least one additional hot water pipe for the return of hot consumption water, b) at least one closed recirculation pipe for heating a space and/or other fluid;

wherein the gray water collection installation comprises at least one of the following:

a) an additional gray water utilization pipe which connects the gray water pipe: to at least one point of the cold and/or hot water branch of the water supply installation, and/or to a reservoir or cistern of flushometer, and wherein the additional gray water utilization pipe comprises a non-return valve, b) a gray accumulation reservoir that comprises water discharge conditions by overflowing and/or overweight and sediment/foam remover, and where said gray accumulation reservoir connects to at least three joining points: i) at least one drain from the gray water collection installation, through which water form the consumption point arrives ii) at least an additional gray water collection installation where water does not come from the consumption point, iii) at least a sanitation device, and iv) a waste water pipe.

13. The plumbing installation according to claim 12, wherein said plumbing installation further comprises external sensors and/or external actuators in communication with the water control system, and at least one of the following: a) a flow shut-off valve, b) an additional non-return valve, c) a pressure regulating valve, and d) an air venting valve.

* * * * *